US007619578B2

(12) United States Patent
Kanno

(10) Patent No.: US 7,619,578 B2
(45) Date of Patent: Nov. 17, 2009

(54) WIDEBAND SLOT ANTENNA

(75) Inventor: Hiroshi Kanno, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/176,856

(22) Filed: Jul. 21, 2008

(65) Prior Publication Data

US 2008/0272971 A1 Nov. 6, 2008

Related U.S. Application Data

(63) Continuation of application No. PCT/JP2008/050108, filed on Jan. 9, 2008.

(30) Foreign Application Priority Data

Jan. 11, 2007 (JP) ..... 2007-003002

(51) Int. Cl.
*H01Q 13/10* (2006.01)

(52) U.S. Cl. ..... 343/767; 343/700 MS

(58) Field of Classification Search ..... 343/767, 343/700 MS, 770, 846
See application file for complete search history.

(56) References Cited

U.S. PATENT DOCUMENTS

| | | | | |
|---|---|---|---|---|
| 5,539,414 | A | 7/1996 | Keen | |
| 5,821,902 | A | 10/1998 | Keen | |
| 6,292,153 | B1 * | 9/2001 | Aiello et al. | 343/767 |
| 6,456,228 | B1 | 9/2002 | Granhed et al. | |
| 6,664,931 | B1 * | 12/2003 | Nguyen et al. | 343/767 |
| 6,864,848 | B2 * | 3/2005 | Sievenpiper | 343/767 |
| 6,885,342 | B2 | 4/2005 | Saegrov et al. | |
| 7,002,519 | B2 * | 2/2006 | Wang et al. | 343/702 |
| 7,397,439 | B2 * | 7/2008 | Kanno et al. | 343/767 |
| 7,538,736 | B2 * | 5/2009 | Kanno et al. | 343/767 |
| 2003/0117329 | A1 | 6/2003 | Saegrov et al. | |
| 2005/0275539 | A1 | 12/2005 | Sakama et al. | |

FOREIGN PATENT DOCUMENTS

| | | |
|---|---|---|
| JP | 5-48414 | 6/1993 |
| JP | 08-023224 | 1/1996 |
| JP | 9-505696 | 6/1997 |
| JP | 10-041738 | 2/1998 |
| JP | 2000-196342 | 7/2000 |

(Continued)

OTHER PUBLICATIONS

Japanese Office Action, with English translation and certification of English translation, issued in Japanesse Patent Application No. JP 2008-517056, mailed Sep. 9, 2008.

(Continued)

*Primary Examiner*—Tho G Phan
(74) *Attorney, Agent, or Firm*—McDermott Will & Emery LLP

(57) ABSTRACT

A wideband slot antenna according to the present invention is a ¼ effective wavelength slot antenna in which a ground conductor 103 having a finite area is allowed to function as a dipole at lower frequencies. An inductive region 123 is provided within an feed line 113 in a region intersecting a slot 111, and an antenna feed point 117 for connection to an external unbalanced feed circuit is provided at a position which satisfies high impedance conditions for an unbalanced ground conductor current.

2 Claims, 24 Drawing Sheets

FOREIGN PATENT DOCUMENTS

| | | |
|---|---|---|
| JP | 2003-523121 | 7/2003 |
| JP | 2004-282568 | 10/2004 |
| JP | 2004-336328 | 11/2004 |
| JP | 2005-277897 | 10/2005 |
| JP | 2006-25390 | 1/2006 |

OTHER PUBLICATIONS

P. Lindberg, et al., "Wideband Slot Antenna for Low-Profile Hand-Held Terminal Applications," Proceedings of the 36th European Microwave Conference, IEEE, Sep. 2006, pp. 1698-1701.

Xiaoxing Yin, et al.., "An Ultra Wideband Tapered Slot Antenna," 2005 IEEE Antennas and Propagation Society International Symposium Digest, United States, IEEE, Jun. 2005, vol. 2A, pp. 516-519.

W. Shen, et al., "Study on Asymmetric Tapered Slotline Antenna," the Third International Conference on Ultrawideband and Ultrashort Impulse Signals, Proceedings, United States, IEEE, Sep. 2006, pp. 156-158.

Japanese Notice of Reasons for Rejecron, w/ English translation thereof, issued in Patent Application No. JP 2008-517056 dated on Sep. 9, 2008.

Zhu, L., et al., "A Novel Broadband Microstrip-Fed Wide Slot Antenna With Double Rejection Zeros," IEEE Antennas and Wireless Propagation Letters, 2003, p. 194-196, vol. 2.

Fukasawa, T., et al., "Impedance Measurement of the Antenna on the Portable Telephone using Fiber-optics," 2003 Grand Meeting of the Institute of Electronics, Information, and Communication Engineers, 2003, p. 206, B-1-206, Mitsubishi Electric Corporation.

* cited by examiner

PRIOR ART

PRIOR ART

WIDEBAND SLOT ANTENNA

This is a continuation of International Application No. PCT/JP2008/050108, with an international filing date of Jan. 9, 2008, which claims priority of Japanese Patent Application No. 2007-003002, filed on Jan. 11, 2007, the contents of which are hereby incorporated by reference.

BACKGROUND OF THE INVENTION

1. Field of the Invention

The present invention relates to an antenna with which a digital signal or an analog high-frequency signal, e.g., that of a microwave range or an extremely high frequency range, is transmitted or received.

2. Description of the Related Art

For two reasons, wireless devices are desired which are capable of operating in a much wider band than conventionally. A first reason is the need for supporting short-range wireless communication systems, for which the authorities have given permission to use a wide frequency band. A second reason is the need for a single terminal device that is capable of supporting a plurality of communication systems which use different frequencies.

For example, a frequency band from 3.1 GHz to 10.6 GHz, which has been allocated by the authorities to short-range fast communication systems, corresponds to a bandwidth ratio as wide as 109.5%. As used herein, "a bandwidth ratio" is a bandwidth, normalized by the center frequency f0, of a band. On the other hand, patch antennas and ½ effective wavelength slot antennas, both of which are known as basic antenna structures, have operating bands (as converted to bandwidth ratios) of less than 5% and less than 10%, respectively, and thus cannot realize the above-described widebandness. To take for example the frequency bands which are currently used for wireless communications around the world, a bandwidth ratio of about 30% is required in order to cover from the 1.8 GHz band to the 2.4 GHz band with the same antenna. In order to simultaneously cover the 800 MHz band and the 2 GHz band, a bandwidth ratio of about 90% must be similarly realized. In order to simultaneously cover from the 800 MHz band to the 2.4 GHz band, a bandwidth ratio of 100% or more is required. Thus, as the number of systems to be supported by the same terminal device increases, and as the frequency band to be covered becomes wider, the need will increase for a small-sized wideband antenna.

The open ended ¼ effective wavelength slot antenna, shown in schematic diagrams in FIGS. 22A to 22C, is one of the most basic planar antenna structures (Conventional Example 1). FIG. 22A is an upper schematic see-through view; FIG. 22B is a schematic cross-sectional view taken along line AB; and FIG. 22C is a schematic see-through rear view, as seen through the upper face side. As is shown in FIGS. 22A to 22C, a feed line 113 exists on the upper face of a dielectric substrate 101. A recess is formed in a depth direction 109*a* from an outer edge 105*a* of an infinite ground conductor 103, which in itself is provided on the rear face of the dielectric substrate 101. Thus, it functions as a resonator composed of a slot 111 having an open leading end at an open point 107. The slot 111 is a circuit which is obtained by removing the conductor completely across the thickness direction in a partial region of the ground conductor 103, and which resonates near a frequency fs such that its slot length Ls corresponds to a ¼ effective wavelength. The feed line 113, which partially intersects the slot 111, electromagnetically excites the slot 111. The feed line 113 is connected to an external circuit via an input terminal. Note that, in order to establish input matching, a distance Lm from an open end point 119 of the feed line 113 to the slot 111 is typically set to about a ¼ effective wavelength at the frequency fs. Moreover, a line width W1 of the feed line 113 is typically designed so that the characteristic impedance of the feed line 113 is set to 50 Ω, in accordance with the substrate thickness H and a dielectric constant of the substrate.

As shown in FIG. 23, Japanese Laid-Open Patent Publication No. 2004-336328 (hereinafter "Patent Document 1") discloses a structure for operating the ¼ effective wavelength slot antenna shown in Conventional Example 1 at a plurality of resonant frequencies (Conventional Example 2). Although the band can be expanded through operation at a plurality of resonant frequencies, characteristics which are as ultrawideband as currently desired cannot be obtained with the frequency characteristics shown in Patent Document 1.

Non-Patent Document 1 ("A Novel Broadband Microstrip-Fed Wide Slot Antenna With Double Rejection Zeros" IEEE Antennas and Wireless Propagation Letters, vol. 2, 2003, pages 194 to 196) discloses a method for realizing a wideband operation of a slot resonator with short-circuited both ends, which is a ½ effective wavelength slot antenna (Conventional Example 3). One input matching method for a conventional slot antenna has been to intersect and excite the slot resonator 14 at a point where a ¼ effective wavelength at the frequency fs is obtained, beginning from the open end point 119 of the feed line 113. However, in Conventional Example 3, as shown in FIG. 24 (which shows an upper schematic see-through view), the region spanning a distance Lind from the open end point 119 of the feed line 113 is replaced by a transmission line having a characteristic impedance higher than 50 Ω. The resultant inductive region 121 is coupled to the slot 111 in a substantial center thereof. Herein, Lind is set to a ¼ effective wavelength at the frequency f0, so that the inductive region 121 functions as a separate ¼ wavelength resonator from the slot resonator. This increases the number of resonators within the equivalent circuit structure (which is one in usual slot antennas) into two, and since resonators that are resonating at close frequencies are coupled to each other, a multiple resonance operation is obtained. In the example shown in FIG. 2(b) of Non-Patent Document 1, reflected impedance characteristics as good as −10 dB or less are obtained with a bandwidth ratio 32% (from near 4.1 GHz to near 5.7 GHz). As shown in comparison with respect to the measured characteristics in FIG. 4 of Non-Patent Document 1, the bandwidth ratio of the antenna of Conventional Example 3 are much more wideband than the bandwidth ratio of 9% of a usual slot antenna which is supposedly produced under the same substrate conditions.

Moreover, Non-Patent Document 2 ("Impedance Measurement of the Antenna on the Portable Telephone using Fiber-optics", 2003 Grand Meeting of the Institute of Electronics, Information, and Communication Engineers, B-1-206 2003, page 206; Conventional Example 4) reports that, in a small-sized communication terminal in which the ground conductor area that can be secured for antenna operation is finite, use of an unbalanced feed circuit for feeding will allow an unbalanced ground conductor current occurring in the ground conductor to flow back to the ground conductor of the feed circuit, thus affecting the measurement accuracy of radiation characteristics and impedance characteristics itself. For this reason, Non-Patent Document 2 does not use a high-frequency unbalanced feed circuit for feeding. Rather, as shown in FIG. 25, Non-Patent Document 2 takes the trouble of employing optical fibers to ensure that the ground conductor in the communication terminal is fed in an isolated manner from the feeding system, thus adopting a measurement technique which avoids unfavorable influences of an unbalanced ground conductor current in the small-sized antenna.

As described above, conventional slot antennas not only lack sufficient widebandness but also have a problem in that, even if widebandness is realized within a small shape, their radiation characteristics and reflected impedance characteristics may not remain stable depending on the state of connection with an external unbalanced feed circuit, thus making it difficult to know their characteristics when mounted in terminal devices.

Firstly, as in Conventional Example 1, the operating band of a usual open ended slot antenna, which only has a single resonator structure within its structure, is restricted by the resonation mode band, so that the frequency band in which good reflected impedance characteristics can be obtained only amounts to a bandwidth ratio of less than about 10%.

Although Conventional Example 2 realizes a wideband operation because of a capacitive reactance element being introduced in the slot, it is well conceivable that an additional part such as a chip capacitor is required as the actual capacitive reactance element, and that variations in the characteristics of the newly-introduced additional part may cause the antenna characteristics to vary. Moreover, judging from the examples disclosed in FIG. 14 and FIG. 18 of this document, it is difficult to realize low-return input matching characteristics across an ultrawide band.

In Conventional Example 3, the bandwidth ratio characteristics are only as goods as about 35%. Moreover, use of a slot resonator with short-circuited both ends (which is a ½ effective wavelength resonator) is disadvantageous in terms of downsizing as compared to the antennas of Conventional Example 1 and Conventional Example 2, in which an open ended slot resonator (which is a ¼ effective wavelength resonator) is used.

Even if the principles of multiple resonance operation of Conventional Example 3 are introduced into the ¼ effective wavelength slot antenna design of Conventional Example 1 or Conventional Example 2, when the small-sized antenna operates as shown in Conventional Example 4, an unbalanced ground conductor current will flow back to the ground conductor of the unbalanced feed circuit which is connected to the antenna. Depending on the shape of the unbalanced feed circuit in which an unbalanced ground conductor flows, e.g., the length of a coaxial cable which is connected to the antenna for the purpose of knowing its characteristics, the radiation characteristics and reflected impedance characteristics will change. In particular, the radiation characteristics may drastically change depending on the state of the external circuit.

SUMMARY OF THE INVENTION

The present invention solves the aforementioned conventional problems, and an objective thereof is, in a small-sized wideband slot antenna whose basic construction is an open ended slot antenna, to realize an operation which is more wideband than conventionally and eliminate causes for unstable radiation operation due to connection with an external circuit, thus realizing a stable operation.

A wideband slot antenna according to the present invention comprises: a dielectric substrate having a front face and a rear face; a ground conductor provided on a rear face of the dielectric substrate, the ground conductor having a finite area; a slot recessing into the ground conductor, in a depth direction from an open point at a portion of an outer edge of the ground conductor, one end of the slot being an open end; and a feed line for feeding a high-frequency signal to the slot, the feed line being formed on the front face of the dielectric substrate and at least partially intersecting the slot. On the front face of the dielectric substrate, an antenna feed point for connecting an external unbalanced feed circuit to the feed line is provided at a position facing an outer edge of the ground conductor opposite from the open point; and the feed line is bent by at least 90° within a plane which is parallel to the front face of the dielectric substrate so as to reach the antenna feed point. The slot and the antenna feed point are each disposed at a center of the ground conductor along a width direction which is orthogonal to the depth direction. In an inductive region spanning a length of a ¼ effective wavelength at a resonant frequency fs of the slot from the open end point, a characteristic impedance of the feed line is prescribed to be higher than 50 Ω; and the feed line and the slot intersect each other at a center of the inductive region. A distance from the open point to each outer edge at an end of the ground conductor along the width direction corresponds to a length equal to or less than a ¼ effective wavelength at the frequency fs, and the ground conductor has a lowest-order resonant frequency at a frequency which is lower than the frequency fs.

In a preferred embodiment, the dielectric substrate further has a dielectric layer covering the feed line.

A wideband slot antenna according to the present invention comprises: a dielectric substrate having a front face and a rear face; a ground conductor provided on a rear face of the dielectric substrate, the ground conductor having a finite area; a slot recessing into the ground conductor, in a depth direction from an open point along an outer edge of the ground conductor, one end of the slot being an open end; and a feed line for feeding a high-frequency signal to the slot, the feed line being formed on the front face of the dielectric substrate and at least partially intersecting the slot. On the front face of the dielectric substrate, an antenna feed point for connecting an external unbalanced feed circuit to the feed line is provided at a position facing an outer edge of the ground conductor opposite from the open point. The feed line is bent by at least 90° within a plane of the dielectric substrate so as to reach the antenna feed point; and the slot and the antenna feed point are each disposed at a center of the ground conductor along a width direction which is orthogonal to the depth direction. In an inductive region spanning a length of a ¼ effective wavelength at a resonant frequency fs of the slot from the open end point, a characteristic impedance of the feed line is prescribed to be higher than 50 Ω. The feed line and the slot intersect each other at a center of the inductive region; at a first point near the slot, the feed line branches into a group of branch lines including at least two branch lines, and at least branch line pair in the group of branch lines is connected at a second point near the slot, thus forming at least one loop line in the feed line. The loop line at least partially intersects a border line between the slot and the ground conductor, and the slot is excited at two or more feed points which are at different distances from the open point along the depth direction. A maximum value of a loop length of the entire loop line is prescribed to be a length less than 1× effective wavelength at an upper limit frequency of an operating band; in the group of branch lines, any branch line that does not constitute a part of the loop line but is left open-ended at a leading end has a branch length which is less than ¼ effective wavelength at an upper limit frequency of the operating band. A distance from the open point to each outer edge at an end of the ground conductor along the width direction is prescribed to a length equal to or less than a ¼ effective wavelength at the frequency fs, and the ground conductor has a lowest-order resonant frequency at a frequency which is lower than fs.

In a preferred embodiment, the dielectric substrate further has a dielectric layer covering the feed line.

In accordance with a wideband slot antenna of the present invention, a wideband operation can be realized which has been difficult to realize with conventional slot antennas. Moreover, instability in radiation characteristics occurring due being connected with an external unbalanced feed circuit which is connected to the antenna is eliminated, whereby stable operation is made possible.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

FIG. 6A illustrates a loop line structure; FIG. 6B illustrates an open-ended stub line structure; and FIG. 6C illustrates a loop line structure, where a second path is made extremely short.

FIG. 7A illustrates a traditional transmission line; and FIG. 7B illustrates a branching transmission line.

FIG. 17A illustrates a case where Lc=50 mm; and FIG. 17B illustrates a case where Lc=150 mm.

FIG. 18A illustrates a case where Lc=50 mm; and FIG. 18B illustrates a case where Lc=150 mm.

FIG. 19A illustrates a case where Lc=50 mm; and FIG. 19B illustrates a case where Lc=150 mm.

FIG. 20A illustrates a case where Lc=50 mm; and FIG. 20B illustrates a case where Lc=150 mm.

FIG. 21A illustrates a case where Lc=50 mm; and FIG. 21B illustrates a case where Lc=150 mm.

FIG. 22A is an upper schematic see-through view; FIG. 22B is a cross-sectional side schematic view; and FIG. 22C is a rear schematic view as seen through an upper face.

DETAILED DESCRIPTION OF PREFERRED EMBODIMENTS

Hereinafter, embodiments of the present invention will be described with reference to the drawings.

Embodiments

Figure 1:
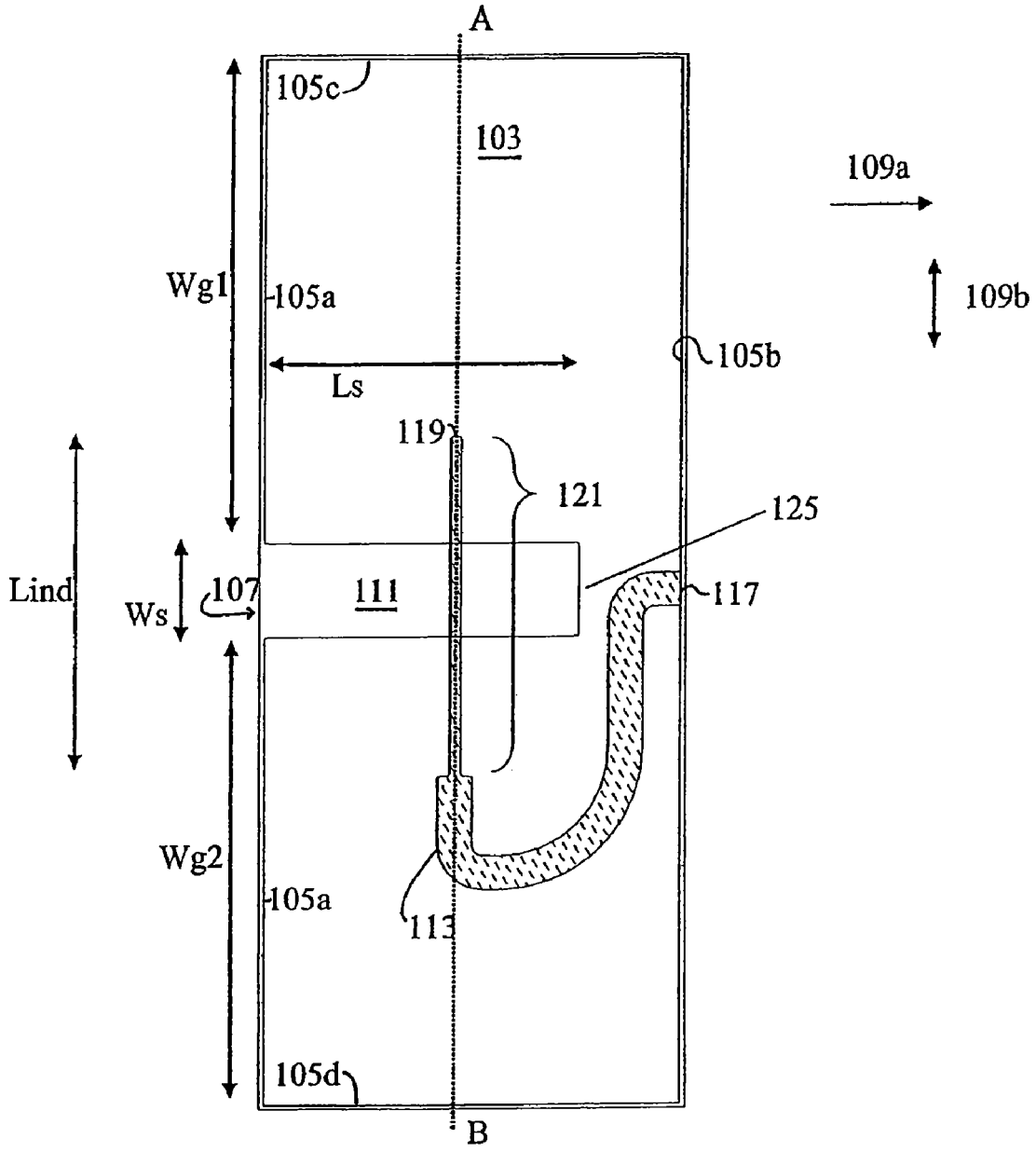
FIG. 1 is an upper schematic see-through view of a wideband slot antenna according to a first embodiment of the present invention.

FIG. 1 is an upper schematic see-through view illustrating the structure of a wideband slot antenna according to a first embodiment of the present invention.

A ground conductor 103 having a finite area is formed on a rear face of the dielectric substrate 101. A slot 111 recesses into the ground conductor 103 in a depth direction 109*a*, from an open point 107 which is provided at an outer edge 105*a* extending along a width direction 109*b* of the ground conductor 103, with one end of the slot 111 being left open. The slot 111 functions as a ¼ effective wavelength open ended slot resonator. Assuming that the slot width Ws is negligible relative to the slot length Ls, a resonant frequency fs of the slot 111 is a frequency such that the slot length Ls corresponds to a ¼ effective wavelength.

In the case where the above assumption does not hold true, the resonant frequency fs of the slot 111 is a frequency such that a slot length which takes the slot width into consideration (Ls×2+Ws)÷2 corresponds to a ¼ effective wavelength.

Preferably, the resonant frequency fs according to the present invention is prescribed to be approximately a center frequency f0 of the operating frequency band. A feed line 113 which at least partially intersects the slot 111 is formed on a front face of the dielectric substrate 101.

Figure 2A:
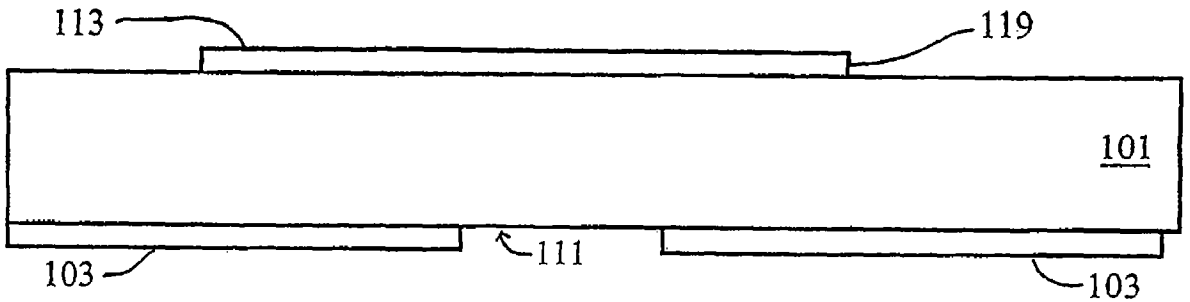
FIG. 2A is a schematic cross-sectional view of the wideband slot antenna according to the present invention shown in FIG. 1.
Figure 2B:
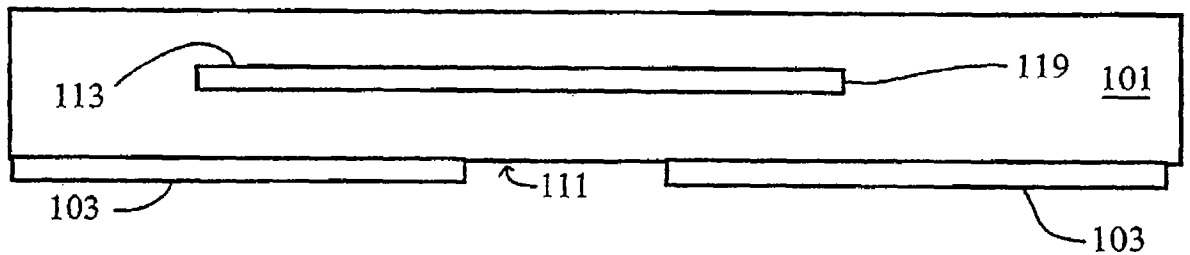
FIG. 2B is a schematic cross-sectional view of another embodiment of a wideband slot antenna according to the present invention.
Figure 2C:
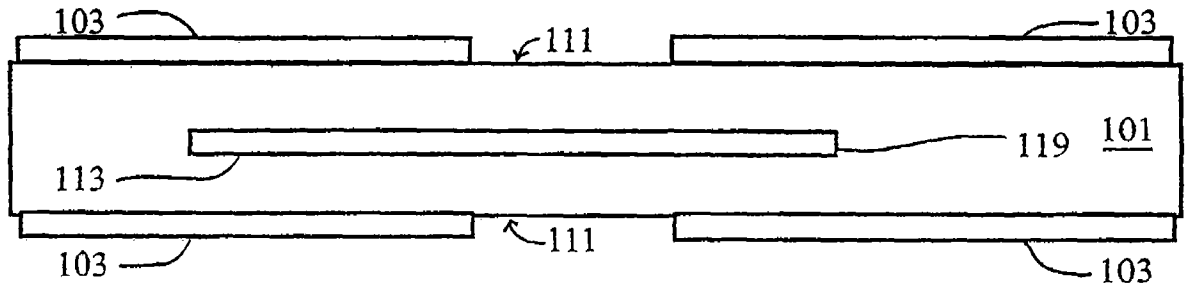
FIG. 2C is a schematic cross-sectional view of still another embodiment of a wideband slot antenna according to the present invention.

FIG. 2A shows a schematic cross-sectional view of the wideband slot antenna, taken along a dotted line AB in FIG. 1. The present specification illustrates a structure in which the feed line 113 is disposed on the frontmost face of the dielectric substrate 101 and the ground conductor 103 is disposed on the rearmost face of the dielectric substrate 101. However, as illustrated in FIG. 2B, by methods such as adopting a multilayer substrate in which a plurality of dielectric layers and conductive layers are stacked, either or both of the feed line 113 and the ground conductor 103 may be disposed at an inner layer plane of the dielectric substrate 101. Moreover, it is not a limitation that there is one conductor wiring surface functioning as a ground conductor 103 for the feed line 113. As shown in FIG. 2C, a structure may be adopted in which opposing ground conductors 103 sandwich a layer in which the feed line 113 is formed. In other words, the wideband slot antenna according to the present invention can provide similar effects in a circuit structure in which a strip line circuit structure, as well as a microstrip line structure, is adopted in at least a portion thereof. The same is also true of a coplanar waveguide and a grounded coplanar waveguide structure.

As used in the present specification, the term "dielectric substrate" broadly encompasses a dielectric layer or a dielectric multilayer substrate having a ground conductor formed on one face (rear face) and a feed line formed on another face (front face) thereof. Alternatively, to a "dielectric substrate" having a feed line formed on a surface thereof, another dielectric layer may be added so as to cover the feed line. In other words, the wideband slot antenna according to the present invention encompasses all of the constructions of FIGS. 2A to 2C.

Note that, in the present specification, a "slot" is defined as a portion of the conductor layer composing the ground conductor 103 where the conductor is completely removed along the thickness direction thereof. In other words, any portion of the ground conductor 103 which is merely ground off its surface in a partial region to result in a reduced thickness is not a "slot".

The ground conductor 103 is a conductor structure having a finite region, which, along the outer edge 105*a*, extends over lengths Wg1 and Wg2 on both sides from the open point 107 along the width direction 109*b*. Herein, Wg1 and Wg2 each has a value which is equal to or greater than a length Lsw that corresponds to a ¼ effective wavelength at the frequency fs. This is a necessary condition for stabilizing the antenna radiation characteristics of the slot mode.

On the other hand, because of having a circuit area which is limited within a finite region, the ground conductor according to the present invention operates also as a ground conductor dipole antenna which makes use of the entire ground conductor structure. A ground conductor dipole antenna and an open ended slot antenna are similar in that high-frequency currents concentrate to flow at a short-circuiting point of a slot, both antennas can provide radiation characteristics with common polarization characteristics, while sharing the same circuit board.

If the resonant frequency fd of the ground conductor dipole antenna can be prescribed to be slightly lower than the resonant frequency fs of the open ended slot mode, rather than being equal to the resonant frequency fs, the operating band of the wideband slot antenna can be expanded toward the lower frequency side.

Since the ground conductor 103 has a slot portion in a substantially central portion thereof, the resonator length of the ground conductor dipole antenna is effectively extended. As a result, in a wideband slot antenna according to the present invention in which Wg1 and Wg2 are set to values equal to or greater than Lsw, the frequency fd will always be lower than the resonant frequency fs, whereby a wideband operation is guaranteed. From the standpoint of downsizing, it would not be practical for the frequency fd to have a much lower value than the operating band frequency of the slot mode. In other words, by prescribing both Wg1 and Wg2 to the least necessary value, it becomes possible to bring the frequency fd close to the operating band of the slot mode while in the form of a small-sized antenna.

A characteristic impedance of the feed line 113 in the region spanning a distance Lind from the open end point 119 is prescribed to be higher than 50 Ω. As a result, the aforementioned region of the feed line 113 constitutes an inductive region 121, such that the distance Lind is approximately equal to a ¼ effective wavelength at the frequency fs. In other words, the inductive region 121 constitutes a ¼ wavelength resonator, and couples to a ¼ effective wavelength resonator that is constituted by the slot 111. This results in multiple resonance, whereby the antenna operating band of the slot 111 in the slot mode is effectively increased.

At the substantial center of the inductive region 121 along its longitudinal direction, the feed line 113 intersects the slot 111. In Conventional Example 1, even if the ground conductor were to be limited to a finite area, it would be difficult to obtain continuity with the band of the ground conductor dipole mode if the band of the slot mode itself were limited, thus making it impossible to obtain effects similar to those of the present invention. According to the present invention, since the slot mode operating band expands toward the lower frequency side as described above, antenna operation is realized in a wide operating band which is continuous with the operating band of the ground conductor dipole.

The inductive region 121 is connected to the usual region of the feed line 113 having a characteristic impedance of 50 Ω. The feed line 113 is bent by at least 90° within a plane which is parallel to the front face of the dielectric substrate 101, and reaches an antenna feed point 117 which is provided at a position facing an outer edge 105*b* of the ground conductor 103.

The antenna feed point 117 is set at a position near the outer edge 105*b*, opposite from the outer edge 105*a* of the ground conductor which extends along the width direction and along which the open point 107 is set. The open point 107 and the antenna feed point 117 are both provided near the center of the ground conductor 103 along the width direction 109*b*.

In an antenna mode that emerges when the feed line 113 excites the slot 111, a high-frequency current occurs at the slot short-circuiting point 125.

Figure 3:
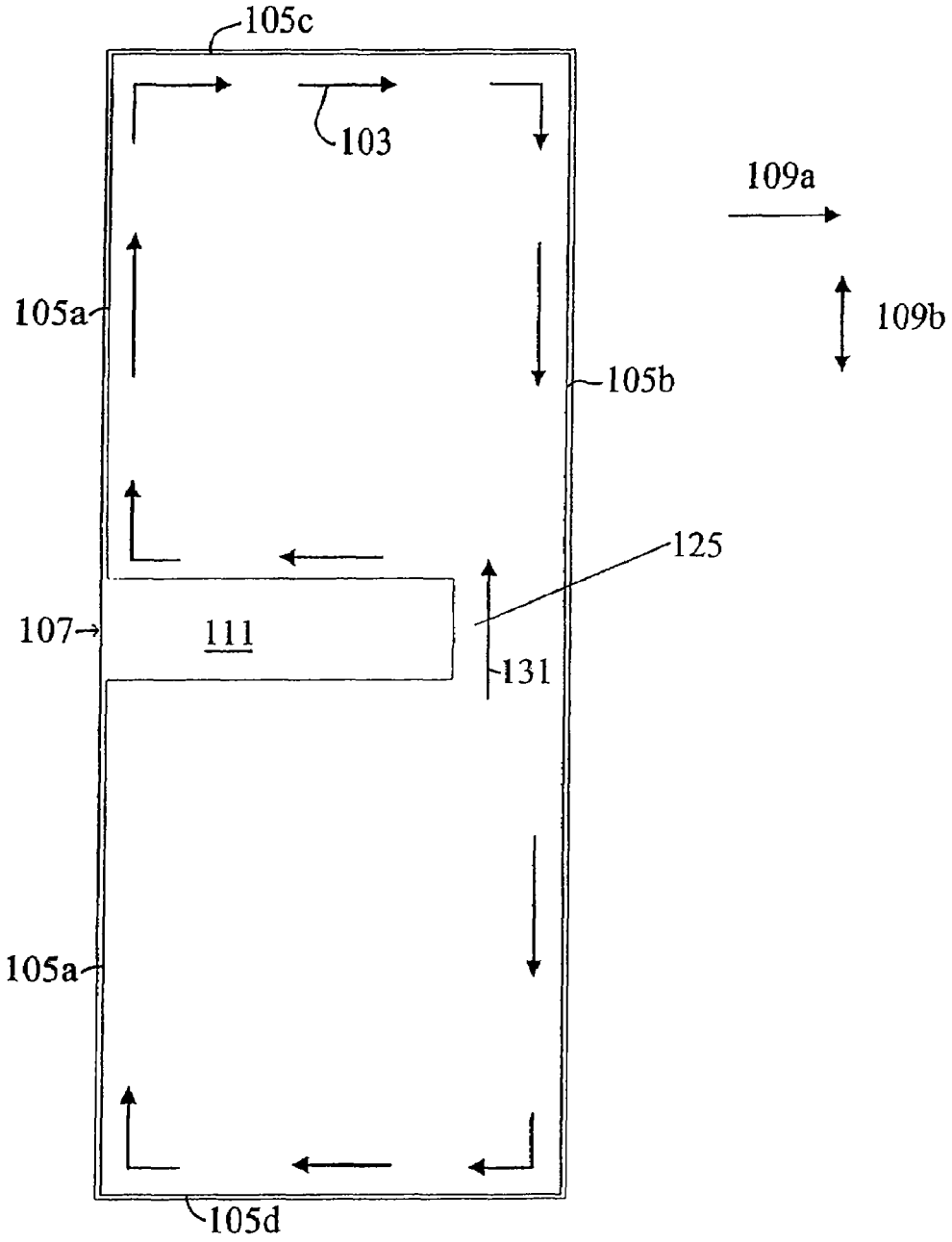
FIG. 3 is a schematic diagram showing high-frequency currents flowing in a ground conductor of a wideband slot antenna according to the present invention.

FIG. 3 schematically shows, with arrows, high-frequency currents 131 flowing through the ground conductor 103. The high-frequency currents 131 occurring due to excitation of the slot 111 flow along the border line between the slot 111 and the ground conductor 103 and reaches the open point 107, and thereafter flows along the outer edges of the ground conductor 103. When another conductor is connected to an outer edge of the ground conductor 103, it becomes very difficult to prevent the high-frequency currents from flowing into the other connected conductor because conductors have a very low impedance. However, by providing an antenna feed point at the aforementioned high-symmetry position, it becomes possible to realize a very high input/output impedance for this high-frequency current, which flows through the ground conductor 103 in an unbalanced manner.

Figure 4A:
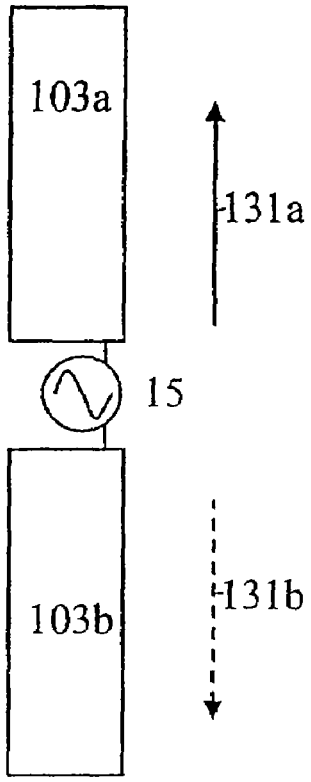
FIG. 4A is a schematic diagram showing how high-frequency currents flow in a ground conductor 103 in a balanced mode.
Figure 4B:
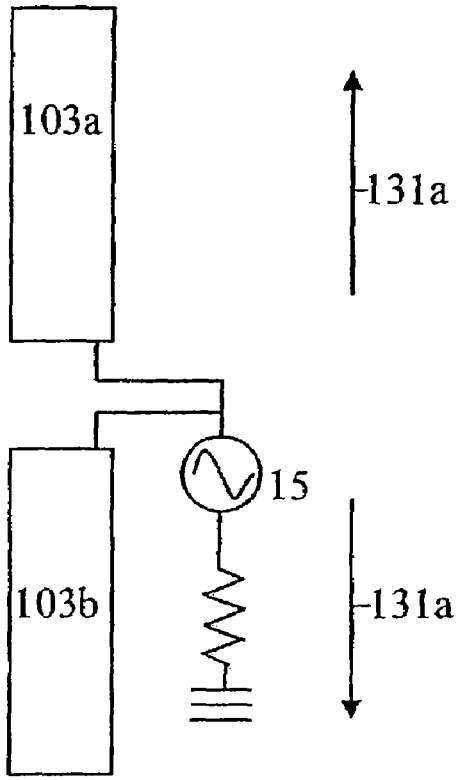
FIG. 4B is a schematic diagram showing how high-frequency currents flow in the ground conductor 103 in an unbalanced mode.

As shown in FIGS. 4A and 4B, the ground conductor 103 in the wideband slot antenna according to the present embodiment can be regarded as a conductor structure in which a highly-symmetrical pair of finite ground conductors 103*a* and 103*b* are combined at the slot short-circuiting point. FIGS. 4A and 4B each schematically show how high-frequency currents flow in the ground conductor 103, in relation to the power-feeding structure in each mode; FIG. 4A illustrates the balanced mode, whereas FIG. 4B illustrates the unbalanced mode.

Under the balanced mode illustrated in FIG. 4A, it is as if out-of-phase high-frequency currents 131*a* and 131*b* were being fed to the ground conductor pair 103*a* and 103*b* in opposite directions from the feed point 15. This amounts to a strongest in-phase high-frequency current flowing at the connection point between the ground conductor pair, i.e., at the slot short-circuiting point. On the other hand, under the unbalanced mode illustrated in FIG. 4B, it is as if in-phase high-frequency currents 131*a* were being fed to the ground conductor pair 103*a* and 103*b* in opposite directions from the center. Consequently, the high-frequency currents at the connection point between the ground conductor pair 103*a* and 103*b* are canceled. This means that, as the symmetry between the ground conductor pair 103*a* and 103*b* increases, and as the antenna feed point becomes closer to the symmetrical point between the ground conductors, there is a higher input/output impedance of the unbalanced ground conductor mode from the antenna feed point according to the present invention. Therefore, even when an external unbalanced feed circuit is connected to the ground conductor 103, the antenna feeding conditions adopted according to the present invention can prevent any unbalanced ground conductor current from flowing back to the ground conductor 103 of the external unbalanced feed circuit.

Note that, in the ½ effective wavelength slot antenna of Conventional Example 3, high-frequency currents occurring at the short-circuiting points at both ends of the slot resonator will flow along the outer edges of the slot, and no electric currents will occur that flow along the outer edges of the ground conductor 103. Thus, the problems of unbalanced ground conductor currents flowing along the outer edges of the ground conductor 103 are unique to the case of performing unbalanced feeding by adopting an open ended slot resonator, which is advantageous for downsizing and widebandness.

In the wideband slot antenna according to the present invention, the slot shape does not need to be rectangular, and may be replaced by any arbitrary shape. In particular, by providing many fine and short slots in parallel connection to the main slot, an inductance which is in series to the main slot can be added to the circuitry and thus the slot length of the main slot can be reduced, which is preferable in practice. Also, under the condition where the main slot is made narrow in slot width and folded into a meandering shape or the like for downsizing, the wideband-realizing effect of the wideband slot antenna according to the present invention can be similarly obtained.

Next, a second embodiment of the wideband slot antenna according to the present invention will be described. In the second embodiment shown in FIG. 5, at the position which is designated as the inductive region 121 in the first embodiment, at least a partial region of the feed line 113 is replaced by a loop line 123. In the present embodiment, the loop line 123 realizes characteristics which are even more wideband than in the first embodiment.

A loop length Lp of the loop line 123 is prescribed to less than 1× effective wavelength at an upper limit frequency fH of the operating band. In other words, the resonant frequency flo of the loop line 123 is prescribed to be higher than the frequency fH. Other than the loop line 123, a part of the feed line 113 may also branch out to form an open stub, but its stub length must be prescribed to less than a ¼ effective wavelength at the upper limit frequency fH of the operating band. In other words, the resonant frequency fst of the open stub is prescribed to be higher than the frequency fH. Thus, in the second embodiment, wiring lines are allowed to branch out from the feed line 113 in the inductive region 123, thereby improving the band characteristics of the wideband slot antenna. This improvement in characteristics is not to be confused with an active utilization of the resonance phenomenon of each branching wiring line alone; instead, it utilizes a phenomenon which is exhibited only because of the combination of a slot antenna and a loop line.

The loop line 123 of a wideband slot antenna according to the embodiment of the present invention increases the number of places where the slot resonator is excitable to more than one, and also adjusts the electrical length of the input matching circuit, whereby an ultrawideband antenna operation is realized.

Hereinafter, the functions of the loop line 123 will be specifically described.

First, high-frequency characteristics in the case where a loop line structure is adopted in a traditional high-frequency circuit will be described, assuming that an infinite ground conductor is provided on a rear face thereof.

Figure 6A:
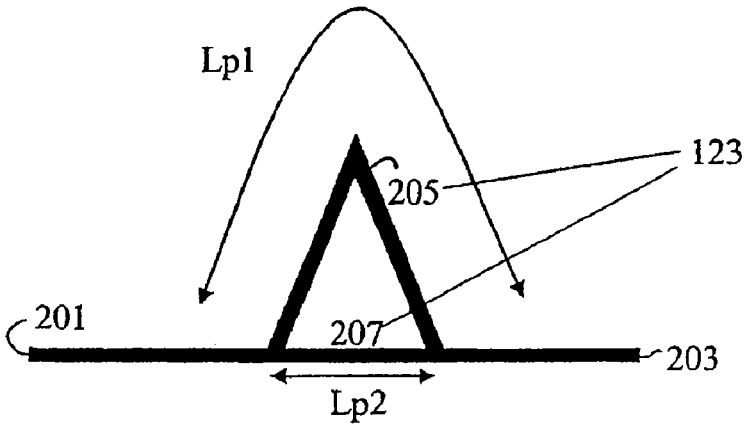
FIGS. 6A, 6B, and 6C are schematic diagrams showing two possible circuits for a traditional high-frequency circuit structure having an infinite ground conductor structure on its rear face, each circuit having a branching portion along a signal line.

FIG. 6A shows a schematic diagram of a circuit in which a loop line 123, composed of a first path 205 (having a path length L1) and a second path 207 (having a path length L2), is connected between an input terminal 201 and an output terminal 203. The loop line resonates under the conditions where a sum of the path length Lp1 of the first path 115*a* and a path length Lp2 of the second path 115*b* equals 1× effective wavelength of the transmission signal, and thus may sometimes be employed as a ring resonator. However, when Lp1 and Lp2 are shorter than the effective wavelength of the transmission signal, the loop line 123 does not exhibit a steep frequency response, and therefore it has not been particularly necessary to employ such a loop line 123 in a usual high-frequency circuit. The reason is that, in a traditional high-frequency circuit having a uniform ground conductor, in a non-resonant band, fluctuations in the local high-frequency current distribution due to the introduction of a loop line will be averaged out in terms of macroscopic high-frequency characteristics.

Figure 5:
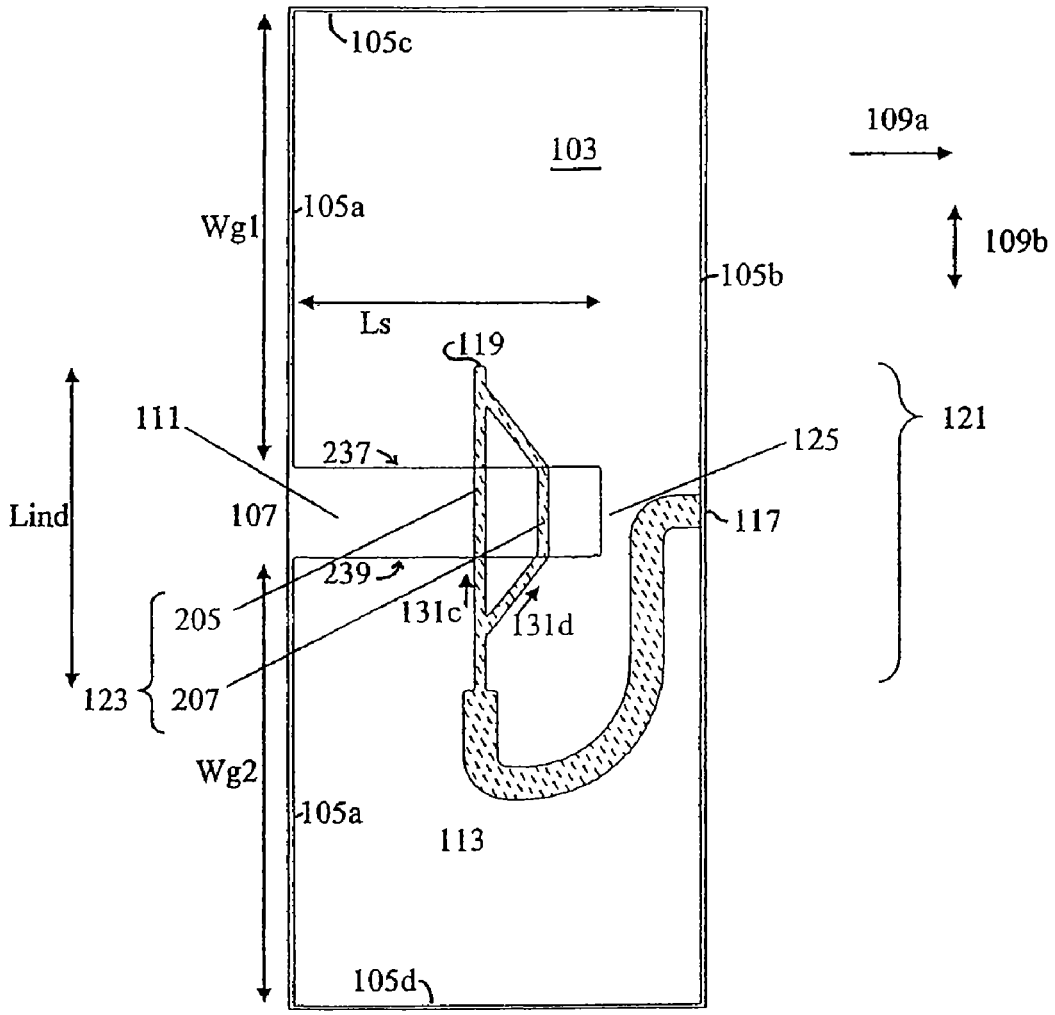
FIG. 5 is an upper schematic see-through view of a wideband slot antenna according to a second embodiment of the present invention.

On the other hand, as shown in the upper schematic see-through view of FIG. 5, introduction of the loop line 123 into a slot antenna according to the present invention provides a unique effect which cannot be obtained in the aforementioned traditional high-frequency circuit. A high-frequency current on the ground conductor can flow in a direction 131*c* along the first path 205, or in a direction 131*d* along the second path 207. As a result, different paths 131*c* and 131*d* can be created in the flow of the high-frequency currents at the ground conductor side, thus enabling the slot 111 to be excited at a plurality of places. Local changes in the high-frequency current distribution in the ground conductor near the slot modulate the slot mode resonance characteristics, and drastically expand the antenna operating band in this mode.

Figure 7A:
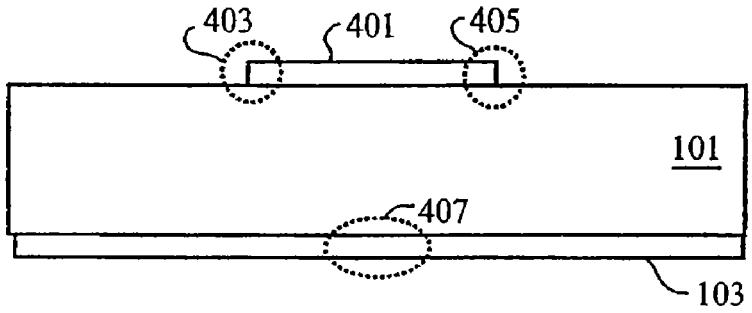
FIGS. 7A and 7B are cross-sectional structural diagrams illustrating places where high-frequency currents concentrate in a ground conductor of a transmission line.
Figure 7B:
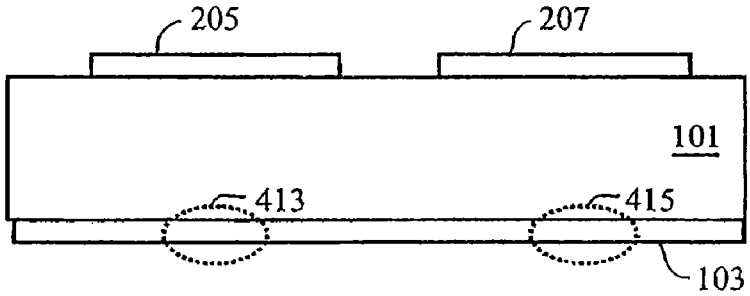

This will be described with reference to FIGS. 7A and 7B, which schematically show cross-sectional structures of transmission lines. In a traditional transmission line as shown in FIG. 7A, it is at ends 403 and 405 of the wiring line that a concentrated distribution of the high-frequency current occurs at the signal conductor 401 side, and it is in a region 407 opposing the signal conductor 401 that the same occurs at the ground conductor 103 side. Therefore, by merely increasing the width of the feed line 113 in the slot antenna, no substantial changes can be caused in the distribution of the high-frequency currents at the ground conductor side. On the other hand, branching the signal conductor into the two paths 205 and 207 as shown in FIG. 7B innovatively allows the high-frequency currents to be separately distributed into different ground conductor regions 413 and 415 respectively opposing the paths 205 and 207.

Moreover, the loop line newly introduced in the wideband slot antenna according to the present invention not only functions to increase the number of places where the slot antenna is excitable to more than one, but also functions to adjust the electrical length of the feed line 113. Fluctuations in the electrical length of the feed line due to the introduction of the loop line allows the resonance conditions of the feed line 113 to further shift to multiple resonance conditions, thus further enhancing the effect of expanding the operating band according to the present invention. Specifically, by introducing the loop line near the slot, based on a difference in electrical length (i.e., the path with the shorter electrical length VS the path with the longer electrical length, among the two paths composing the loop line), it is ensured that a resonance phenomenon which is obtained as the slot resonator couples to the inductive region occurs at a plurality of (two or more) frequencies. Thus, the matching condition which has already been wideband is made even more wideband.

To summarize the above, a wideband slot antenna according to the second embodiment of the present invention is capable of operation in a wider band than that of a conventional slot antenna, based on the combination of a first function of enhancing the resonance phenomenon of the slot itself into multiple resonance and a second function of enhancing the resonance phenomenon of the feed line that couples to the slot into multiple resonance. The location of the antenna feed point is similar to the location of the antenna feed point in the wideband slot antenna according to the first embodiment of the present invention.

However, in order to maintain wideband matching characteristics, it is required that the loop line is not used under conditions where the loop line may resonate by itself. To take the loop line 123 of FIG. 6A for example, the loop length Lp, which is a sum of the path length Lp1 and path length Lp2, is prescribed to be less than 1× effective wavelength at the frequency fH. In the case where a plurality of loop lines exist within one wideband slot antenna, it is necessary that the largest of the loop lines in the antenna satisfies the aforementioned conditions.

Figure 6B:
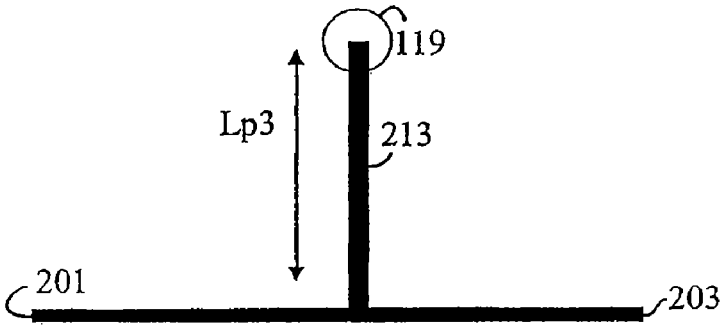
Figure 8:
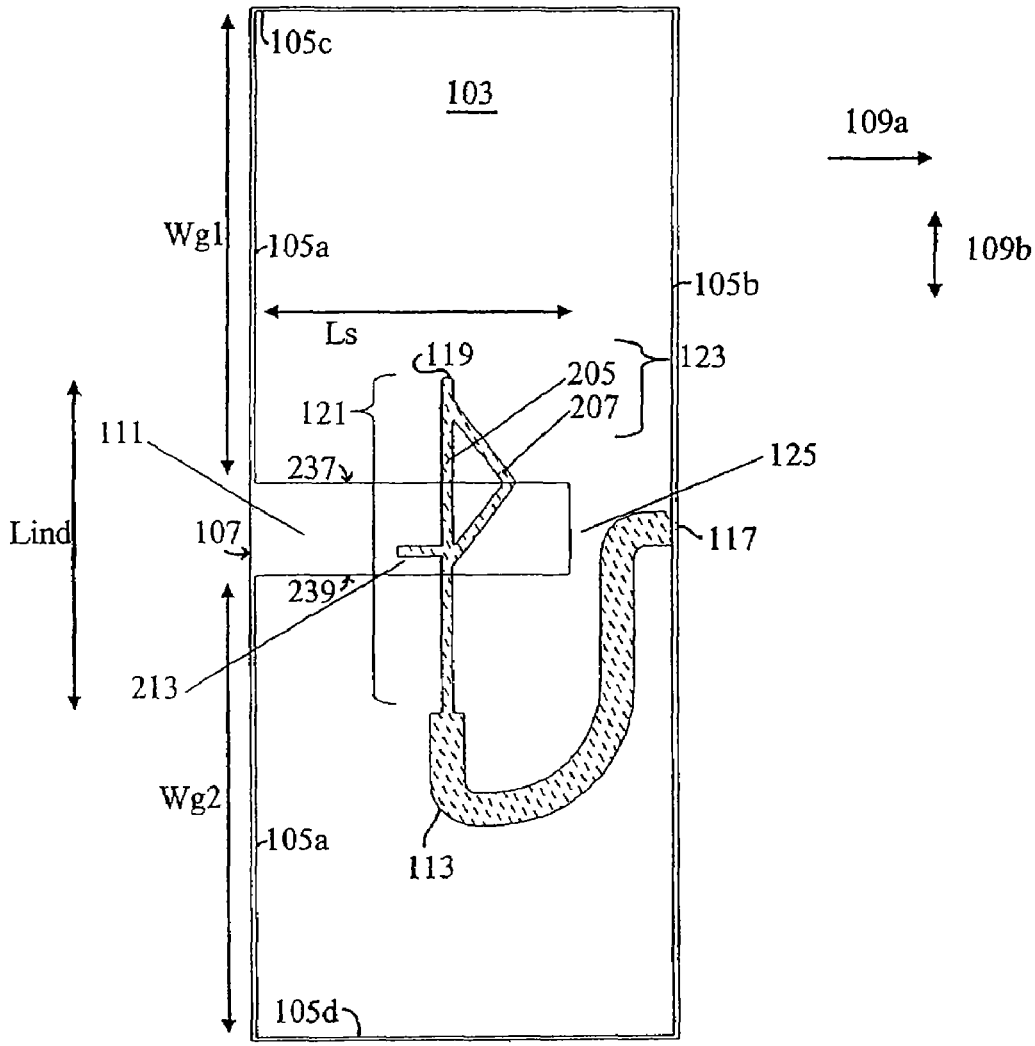
FIG. 8 is an upper schematic see-through view showing a wideband slot antenna according to another embodiment of the present invention.

One high-frequency circuit which is more commonplace than a loop line is an open stub shown in FIG. 6B. As shown in an upper schematic see-through view of FIG. 8, some of the wiring lines branching from the feed line of the wideband slot antenna of the present embodiment may have an open stub structure 213. However, from the standpoint of wideband characteristics, use of a loop line is more advantageous than use of an open stub for the purpose of the present invention. Since the open stub 213 is a ¼ effective wavelength resonator, its stub length Lp must be, at the most, prescribed to be less than ¼ effective wavelength at the frequency fH.

Figure 6C:
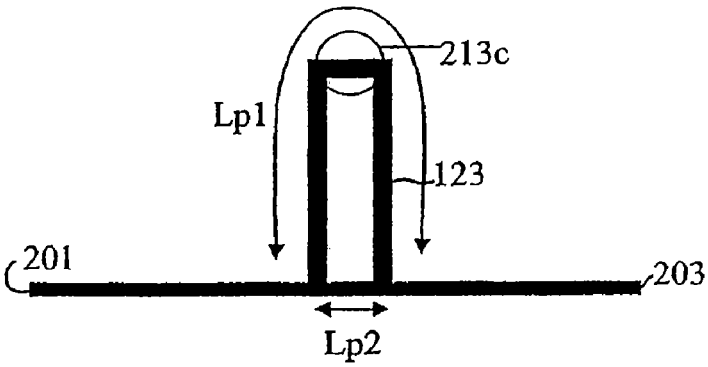

With reference to FIG. 6C showing an exemplary loop line which is characterized by an extremely small Lp2, the advantages of a loop line against an open stub will be described. In the loop line 123, as Lp2 is made extremely small, the loop line 123 will apparently become closer to an open stub. However, the resonant frequency of the loop line in the case where Lp2 approximates zero is a frequency for which Lp1 equals the effective wavelength, and the resonant frequency of an open stub is a frequency for which Lp3 equals a ¼ effective wavelength. If the two structures are compared under conditions where half of the Lp1 is equal to Lp3, the lowest-order resonant frequency of the loop line will correspond to twice the lowest-order resonant frequency of the stub line.

As can be seen from the above description, when converted into frequency band, a loop line is twice as effective a structure, as an open stub, to be adopted for a feed line which must avoid any resonance phenomenon in a wide operating band. Moreover, since an open-end point 119 of the open stub of FIG. 6B is "open" in the circuitry, no high-frequency current will flow through the open-end point 119. Therefore, even if an open-end point 119 is provided near the slot, it will be difficult to attain electromagnetic coupling with the slot. On the other hand, as shown in FIG. 6C, a point 213*c* of the loop line 123 is by no means "open" in the circuitry, and therefore a high-frequency current is certain to flow therethrough. Thus, when provided near the slot, it is easy to attain electromagnetic coupling with the slot. Also from this standpoint, it is more advantageous for the purpose of the present invention to adopt a loop line than to adopt an open stub.

The above description should make it clear that, in order to realize a wideband operation in the wideband slot antenna according to the present invention, it is most effective to introduce a loop line, rather than a line having a thick line width or an open stub.

Figure 9:
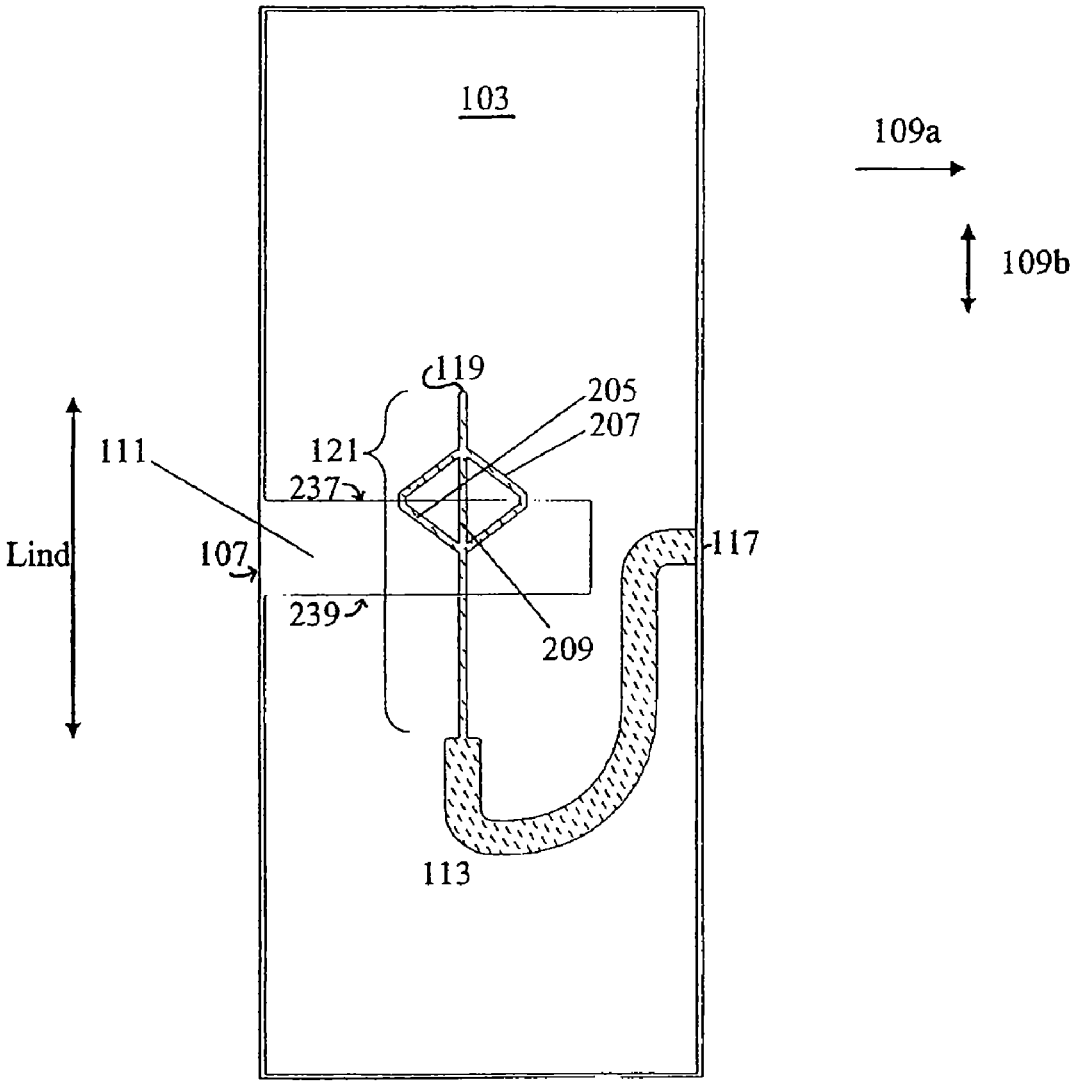
FIG. 9 is an upper schematic see-through view showing a wideband slot antenna according to still another embodiment of the present invention.

FIG. 9 is an upper schematic see-through view of an embodiment in which three branch lines extend from the feed line 113. Although the number of branch lines extending from the feed line 113 may be prescribed to be three or more, not as drastic an expansion of the operating band will be obtained as in the case where there are two branch lines. Within the group of branch lines including a plurality of branches, it is only the paths 205 and 207 at both ends that has a high distribution intensity of high-frequency current, and therefore the high-frequency current flowing through a path 209 lying therebetween does not become very intense. However, inserting the path 209 in between the paths 205 and 207 can improve the resonant frequency of the loop line composed of the paths 205 and 207, which will be effective from the standpoint of expanding the operating band.

The effects of the present invention can be obtained so long as the loop line 123 is provided near the slot. As shown in FIG. 5, it is preferable that the first path 205 and the second path 207 composing the loop line 123 each intersect at least either one of border lines 237 and 239 between the slot 111 and the ground conductor 103.

Figure 10:
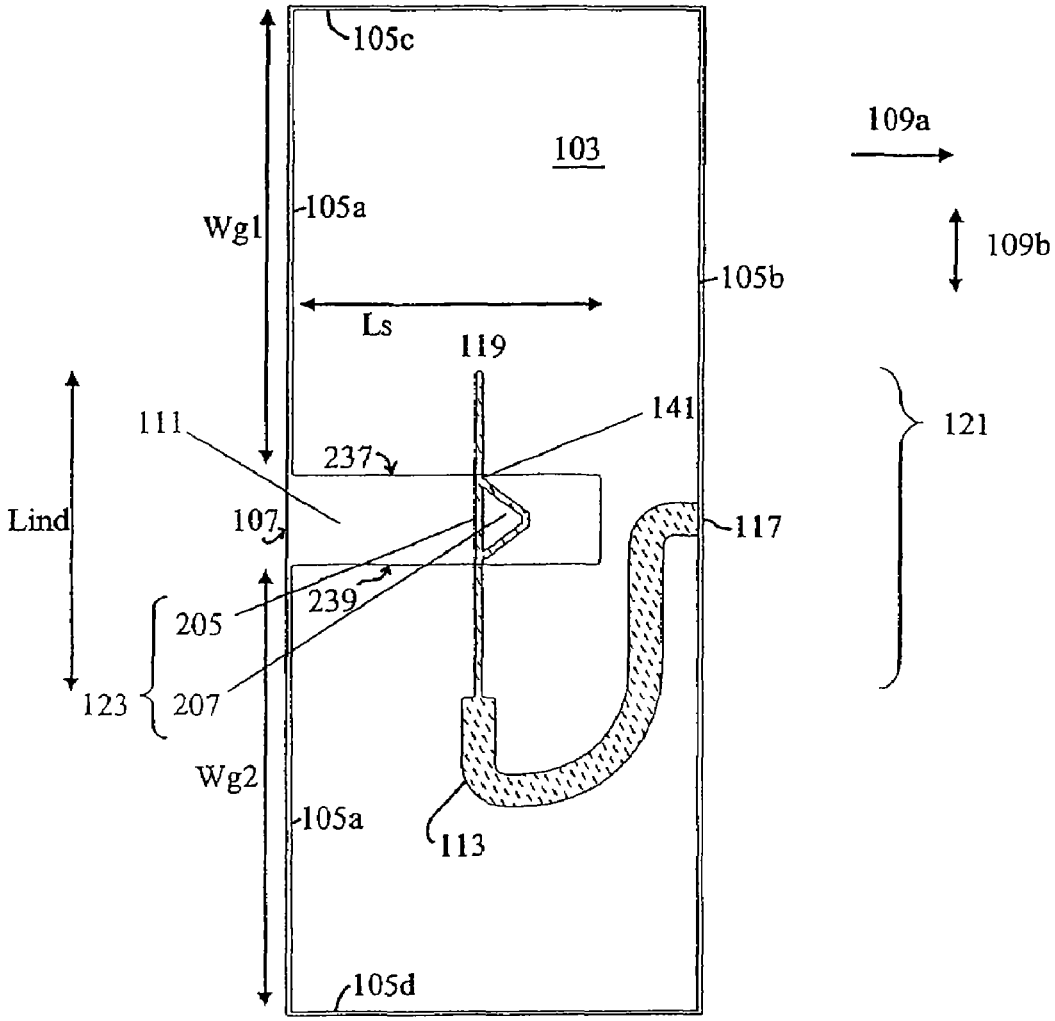
FIG. 10 is an upper schematic see-through view showing a wideband slot antenna according to still another embodiment of the present invention.
Figure 11:
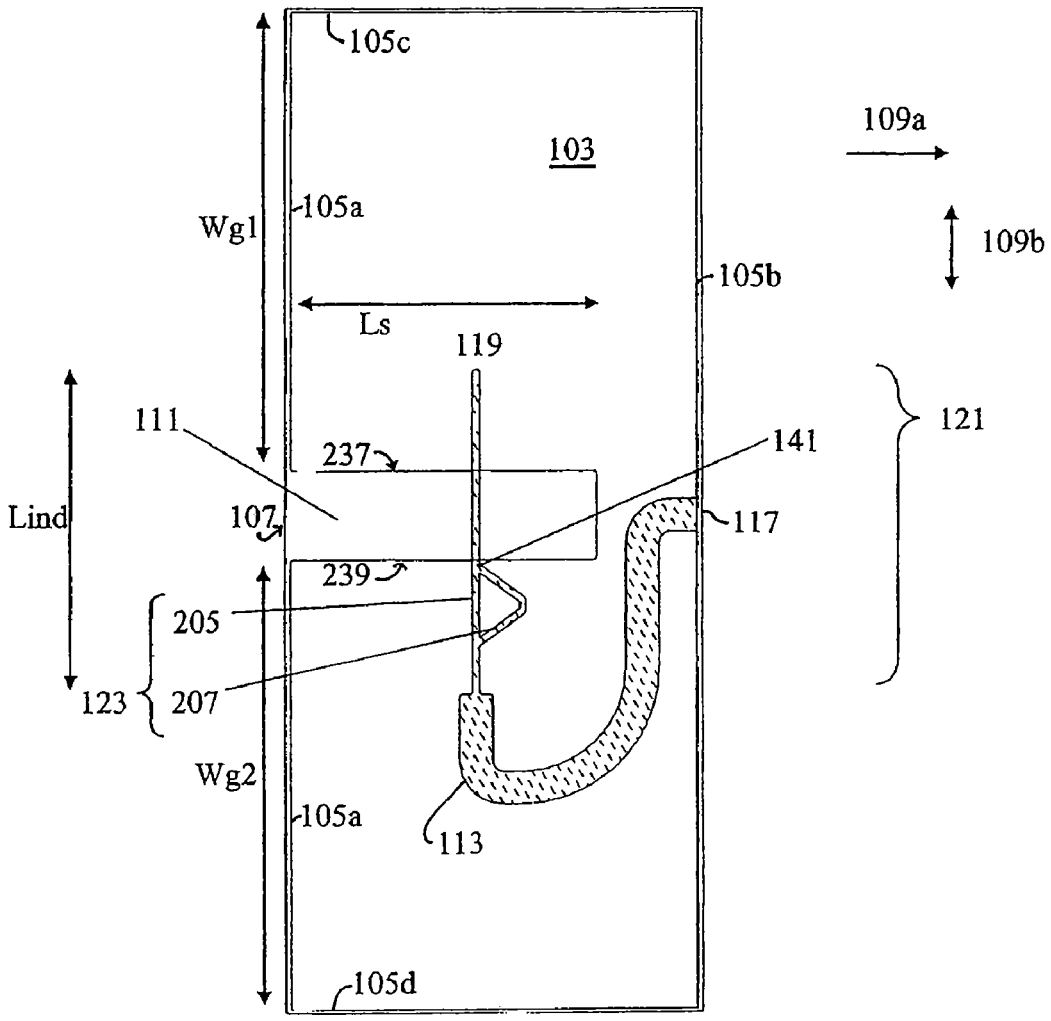
FIG. 11 is an upper schematic see-through view showing a wideband slot antenna according to still another embodiment of the present invention.

Moreover, as shown in FIG. 10 and FIG. 11, it is not impossible to obtain the effects of the present invention with a construction where the loop line 123 intersects neither of the border lines 237 and 239 between the slot 111 and the ground conductor 103 along the depth direction 109*a*. The reason is that, a phase difference corresponding to the path difference between the first path 205 and the second path 207 occurs in the high-frequency currents that excite the slot, thus resulting in an effect of shifting the input matching condition toward the more wideband side. Strictly speaking, it suffices if the gap between the outermost point 141 of the loop line 123 and the border line 237 (or 239) is less than 1× line width of the feed line 113. The reason is that, when the aforementioned gap is prescribed to be shorter than the line width of the feed line 113, the phase difference occurring between the local high-frequency currents flowing at the ground conductor side will not disappear, correspondingly to the phase difference between the high-frequency currents flowing at both ends of the signal conductor.

The loop line 123 is formed in the inductive region 121. It is preferable that the line width is prescribed to be equal to or less than the line width of the feed line in the inductive region 121. A plurality of loop lines may be formed. Such a plurality of loop lines may be connected in series or in parallel to one another. Two loop lines may be directly interconnected, or indirectly connected via a transmission line of an arbitrary shape.

In the wideband slot antenna according to the present invention, bandpass filters or band elimination filters (which are unbalanced input/output circuits), switch ICs, amplification ICs, and the like, or an integrated module accommodating the same may be inserted at any point between the antenna feed point 117 and the inductive region 121.

In the wideband slot antenna according to the present invention, the connection between the ground conductor 103 and an external unbalanced feed circuit to be made at the antenna feed point 117 is not limited to being achieved on the rear face of the dielectric substrate 101. Specifically, via a through-conductor near the connection point, the ground conductor may be guided onto the front face of the dielectric substrate, and a connection may then be made on the front face of the dielectric substrate, based on a coplanar waveguide structure. The advantageous effects of the present invention will not be lost in such a construction. Rather, since both connections, i.e., one for the signal conductor and another for the signal conductor, ground conductor, are realized on the front face of the dielectric substrate, surface mounting of the wideband slot antenna according to the present invention on an external mounting substrate will become possible.

EXAMPLE

Figure 12:
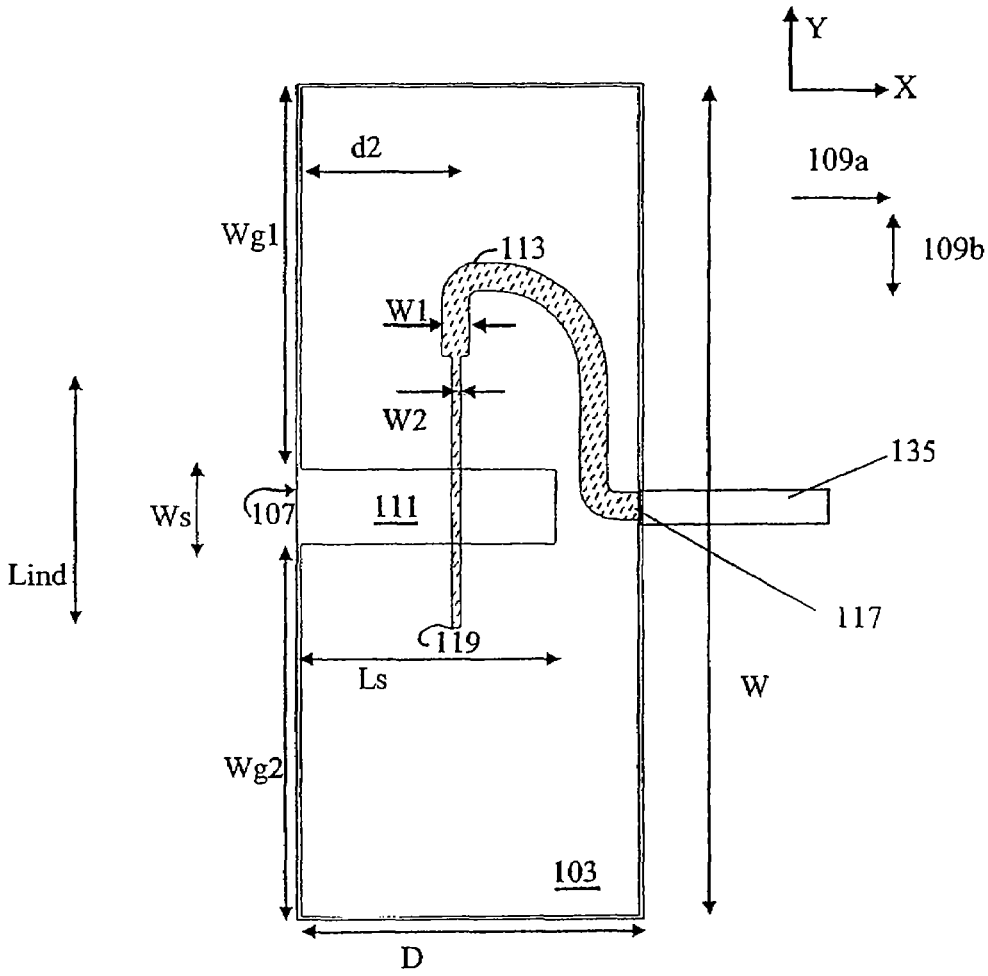
FIG. 12 is an upper schematic see-through view showing Example 1 of the present invention.
Figure 13:
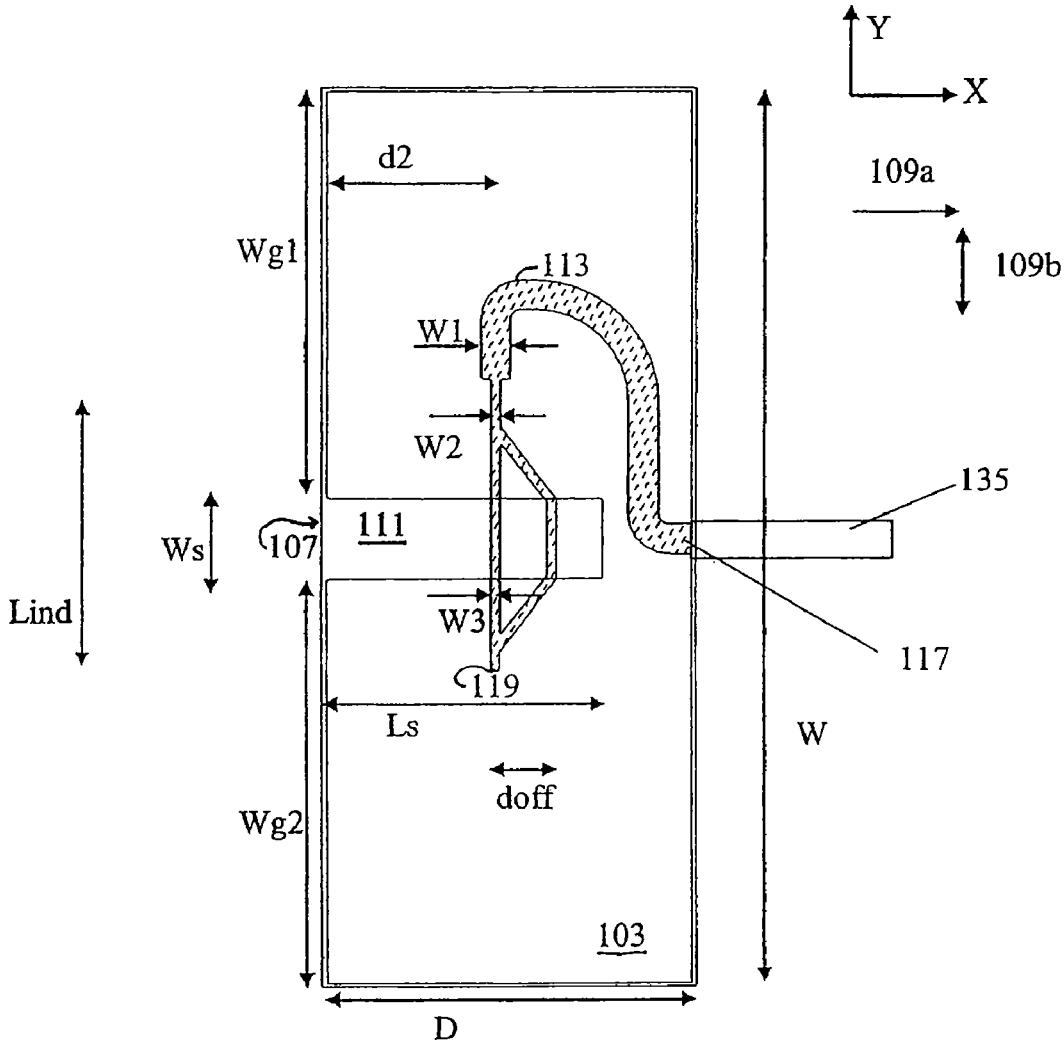
FIG. 13 is an upper schematic see-through view showing Example 2 of the present invention.
Figure 14:
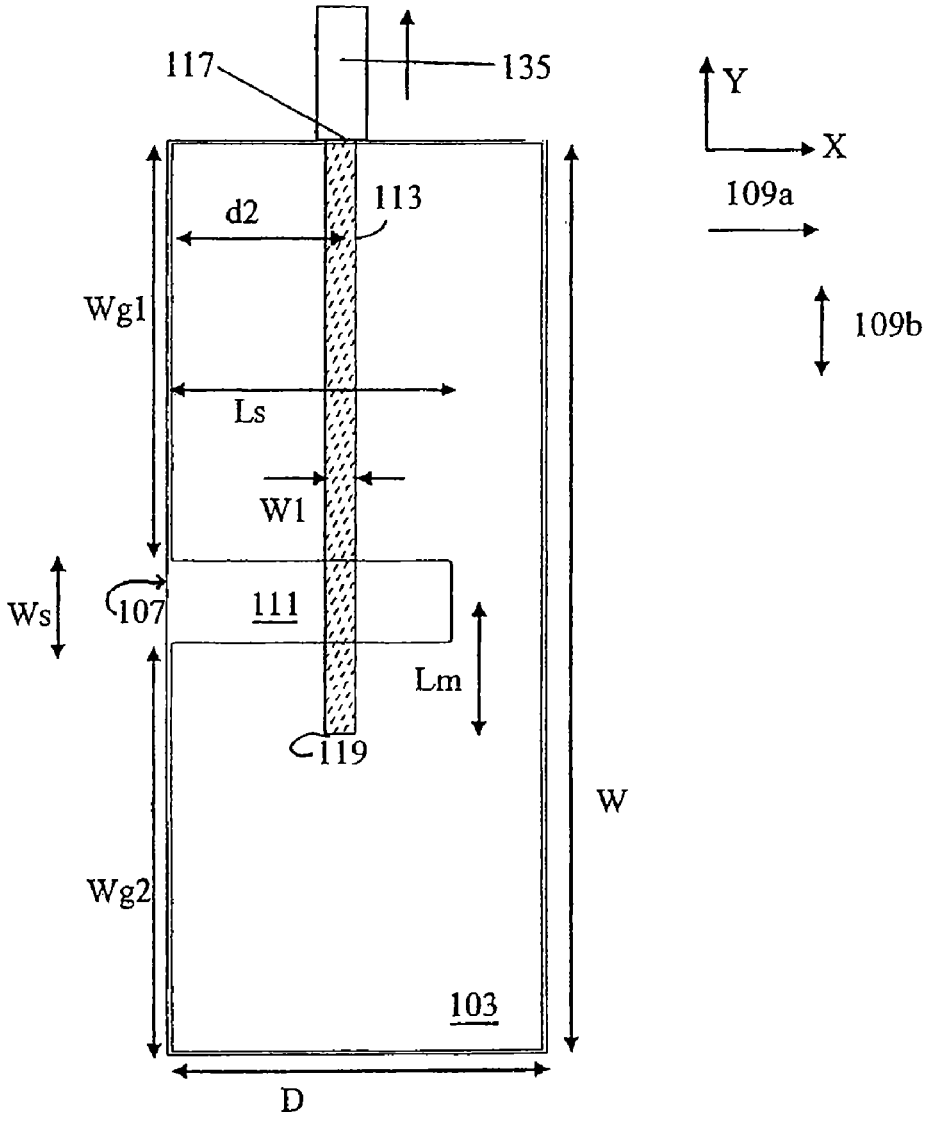
FIG. 14 is an upper schematic see-through view of Comparative Examples 1 and 2 against the present invention.

In order to clarify the effects of the present invention, input impedance characteristics and radiation characteristics of four slot antennas as respectively shown in the upper schematic see-through views of FIG. 12 (Example 1), FIG. 13 (Example 2), and FIG. 14 (Comparative Examples 1 and 2) were analyzed by a commercially-available electromagnetic field simulator. The parameters of the respective circuit boards are summarized in Table 1.

TABLE 1

| condition | relevant to: | |
|---|---|---|
| substrate | all | FR4 |
| substrate thickness H | | 0.5 mm |
| line thickness t | | 0.04 mm |
| D | | 12 mm |
| W | | 30 mm |
| Ls | | 9 mm |
| Ws | | 2.4 mm |
| Wg1 = Wg2 | | 13.8 mm |
| W1 | | 0.95 mm |
| d2 | Comparative Ex. 1, 2 | 6 mm |
| Lm | Comparative Ex. 1 | 4.5 mm |
| Lm | Comparative Ex. 2 | 9 mm |
| W2 | Examples 1, 2 | 0.4 mm |
| W3 | Example 2 | 0.25 mm |
| doff | Example 2 | 1.4 mm |

TABLE 1-continued

| condition | relevant to: | |
|---|---|---|
| direction in which coaxial cable is oriented | Comparative Ex. 1, 2 | Y axis direction in figure |
| | Examples 1, 2 | X axis direction in figure |
| analyzed coaxial cable length Lc | all | 0 mm<br>50 mm<br>150 mm |

Conditions were set for the antennas on the premise that all of the antennas were to be produced on the same size of circuit board. The conductor pattern was assumed to be a copper line having a thickness of 40 microns, and it was ensured that the precision range would fall within what can be obtained through wet etching. At the point shown as the antenna feed point 117 in each figure, a virtual feeding was assumed in which a coaxial connector (not shown) was connecting between the antenna and the coaxial cable 135. As the coaxial cable length Lc, two lengths of 50 mm and 150 mm were assumed, and an ideal feeding was performed at the tip of the coaxial cable. In other words, the operation stability and widebandness of each antenna, including the influences which the coaxial cable having the length Lc to be connected as an unbalanced feed circuit would exert on the characteristics, were analyzed.

An analysis was also performed which assumed that Lc=zero, i.e., an ideal high-frequency feeding was occurring at the antenna feed point 117. In the Comparative Examples, it was assumed that the feed line was not bent, so that the direction in which the coaxial cable was oriented was the Y axis direction in the coordinate axes of FIG. 14. On the other hand, in the Examples, the feed line was bent within the plane so as to extend toward the antenna feed point 117. Therefore, the direction in which the coaxial cable was oriented was the X axis direction in FIGS. 12 and 13.

Figure 15:
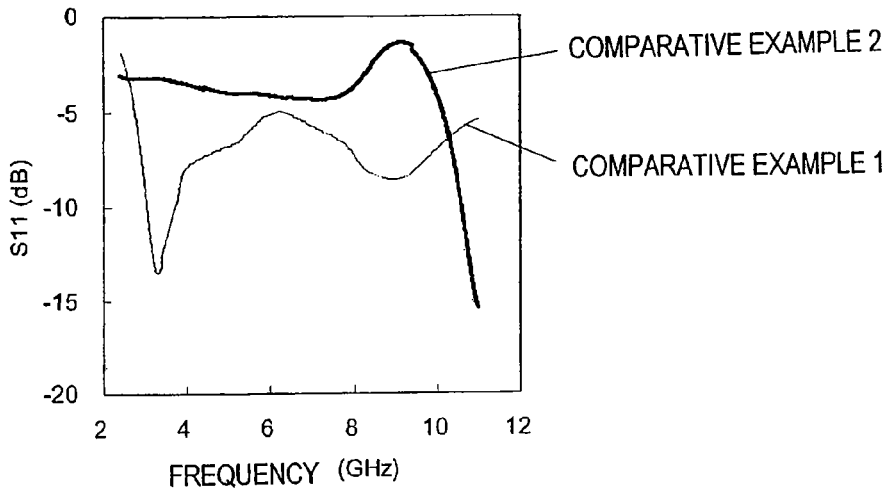
FIG. 15 is a frequency dependence characteristic diagram of return loss at Lc=50 mm in Comparative Examples 1 and 2.

FIG. 15 shows the frequency dependence of return loss in Comparative Example 1 and Comparative Example 2, in the case where Lc=150 mm. In Comparative Example 1, in a 20% bandwidth ratio range from 3.04 GHz to 3.73 GHz, the return loss was less than −10 dB; and from 2.9 GHz to 4.3 GHz, the return loss was less than −7.5 dB. At 6.3 GHz, the return loss reached −4.9 dB, and thus wideband characteristics were not obtained. In Comparative Example 2, the return loss was about −3 dB to about −4 dB from 2.5 GHz to 8 GHz, and thus low-return characteristics were not obtained.

Figure 16:
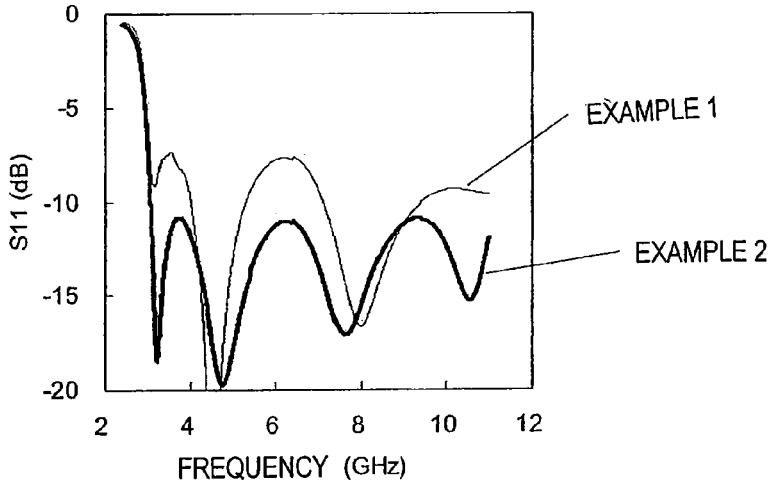
FIG. 16 is a frequency dependence characteristic diagram of return loss at Lc=50 mm in Examples 1 and 2.

On the other hand, FIG. 16 shows the frequency dependence of return loss in Example 1 and Example 2, in the case where Lc=150 mm. Example 1 retained low-return characteristics of −7.5 dB or less, from 3.2 GHz to above 11 GHz. Furthermore, Example 2 exhibited wideband low-return characteristics with a return loss of −10 dB or less, in the entire band from 3.1 GHz to above 11 GHz. As will be clear from a comparison against the Comparative Examples shown in FIG. 15, both Examples achieved wide operating bands. Note that there was hardly any influence of changing Lc on the input impedance, both in the Examples and in the Comparative Examples.

Figure 17B:
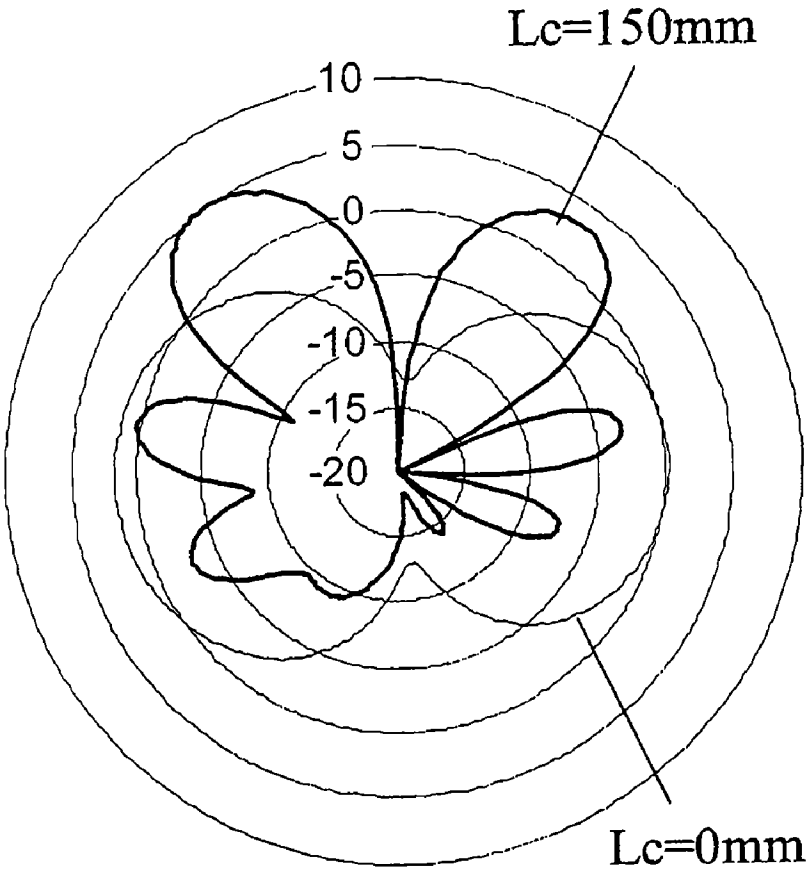
FIGS. 17A and 17B are radiation characteristics diagrams of Comparative Example 1 at 3 GHz.
Figure 17A:
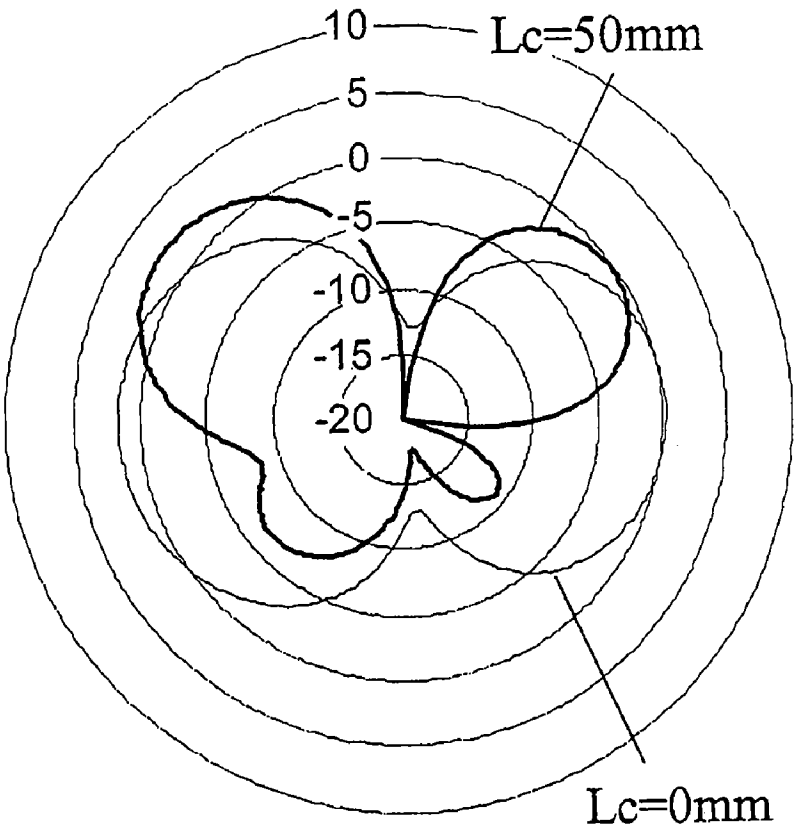
Figure 18B:
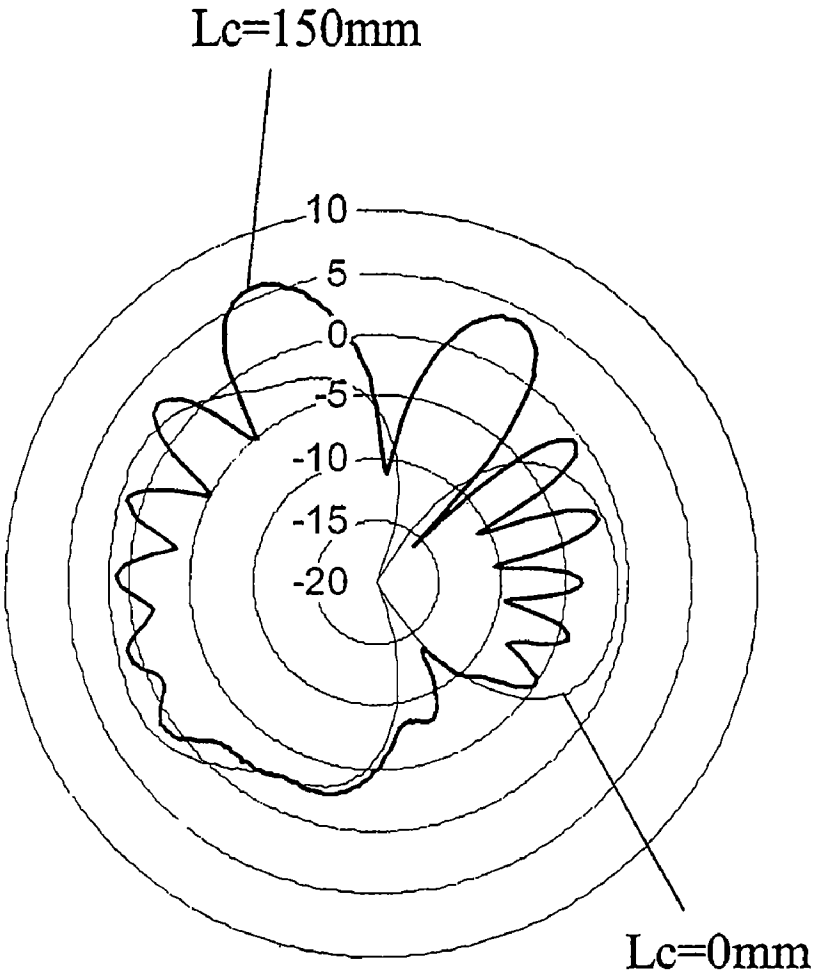
FIGS. 18A and 18B are radiation characteristics diagrams of Comparative Example 1 at 6 GHz.
Figure 18A:
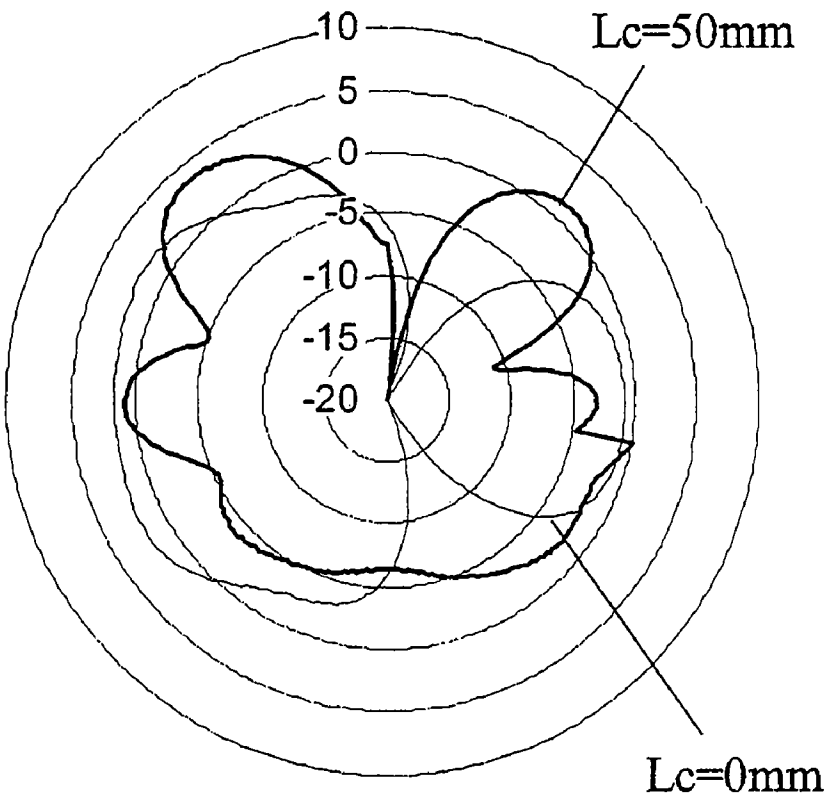

As for the radiation characteristics of Comparative Examples 1 and 2, a tendency was observed that their characteristics greatly varied depending on Lc. FIGS. 17A and 17B show the radiation characteristics on the YZ plane at 3 GHz in Comparative Example 1, in the cases where Lc=50 mm and Lc=150 mm, respectively. The data shown by a thin line in the figures is the characteristics in the case where Lc=zero, which is presented for comparison. If the unfavorable influences of an unbalanced ground conductor current are successfully avoided, which is the objective of the present invention, the three sets of characteristics will coincide; however, entirely different sets of characteristics are obtained depending on Lc. Similarly, FIGS. 18A and 18B show radiation characteristics at 6 GHz. As is clear from FIGS. 17A and 17B and FIG. 18, in the Comparative Examples, at all frequencies, a tendency was confirmed that the radiation characteristics depended strongly on the cable length.

Figure 19B:
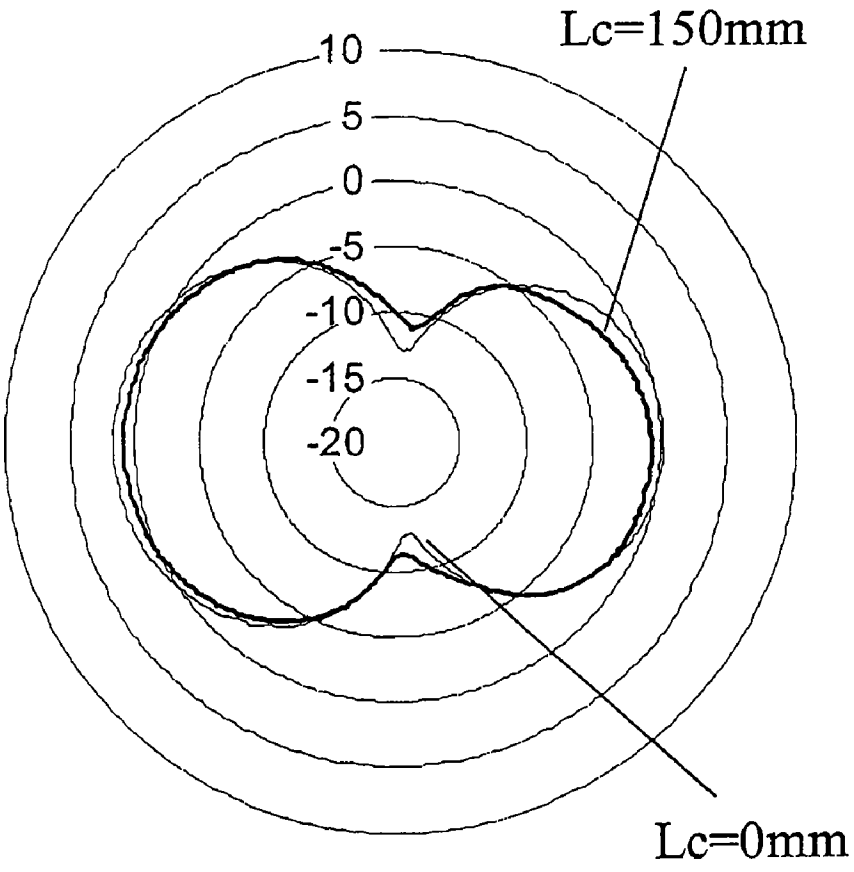
FIGS. 19A and 19B are radiation characteristics diagrams of Example 2 at 3 GHz.
Figure 19A:
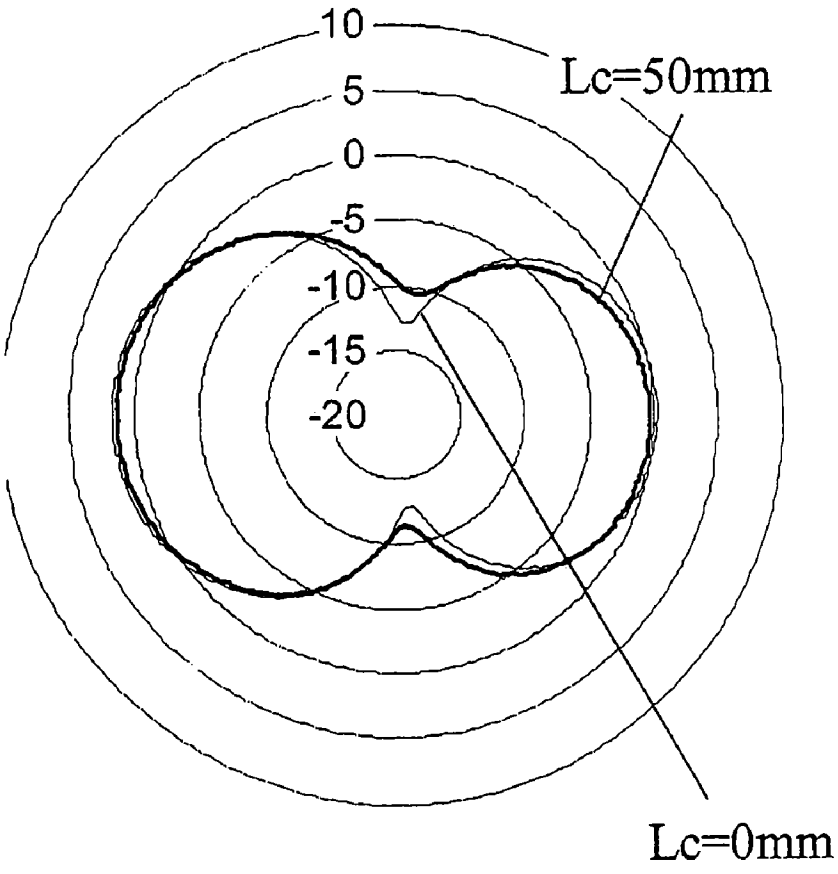
Figure 20A:
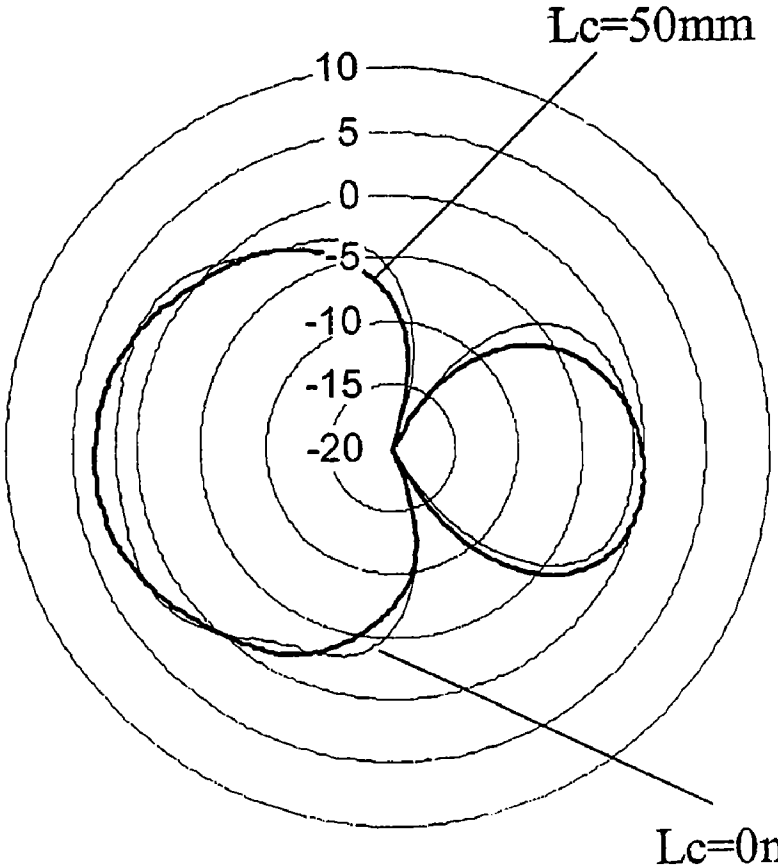
FIGS. 20A and 20B are radiation characteristics diagrams of Example 2 at 6 GHz.
Figure 20B:
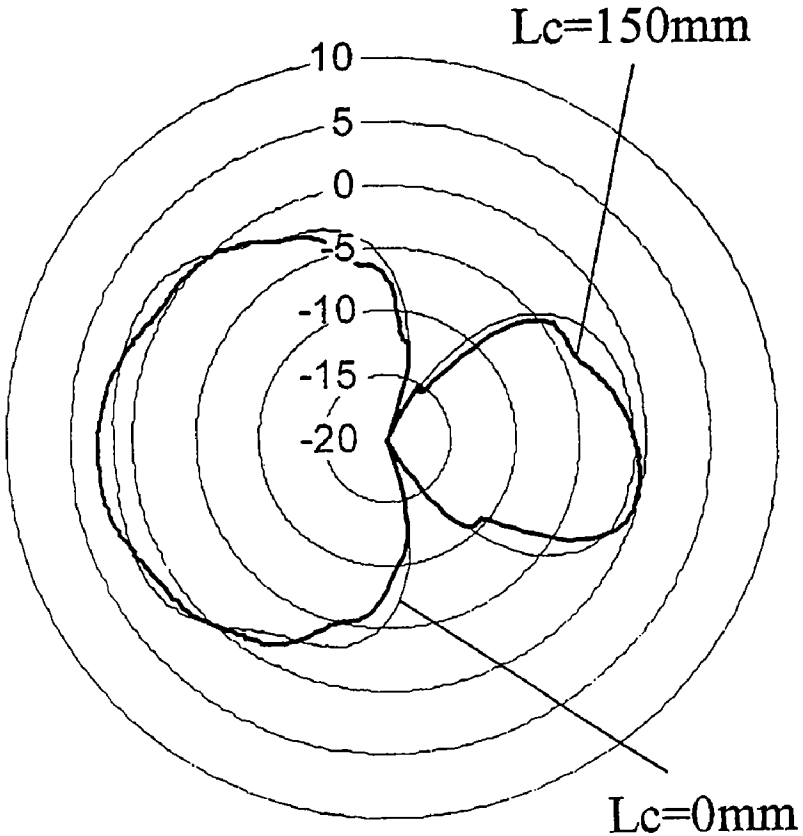
Figure 21A:
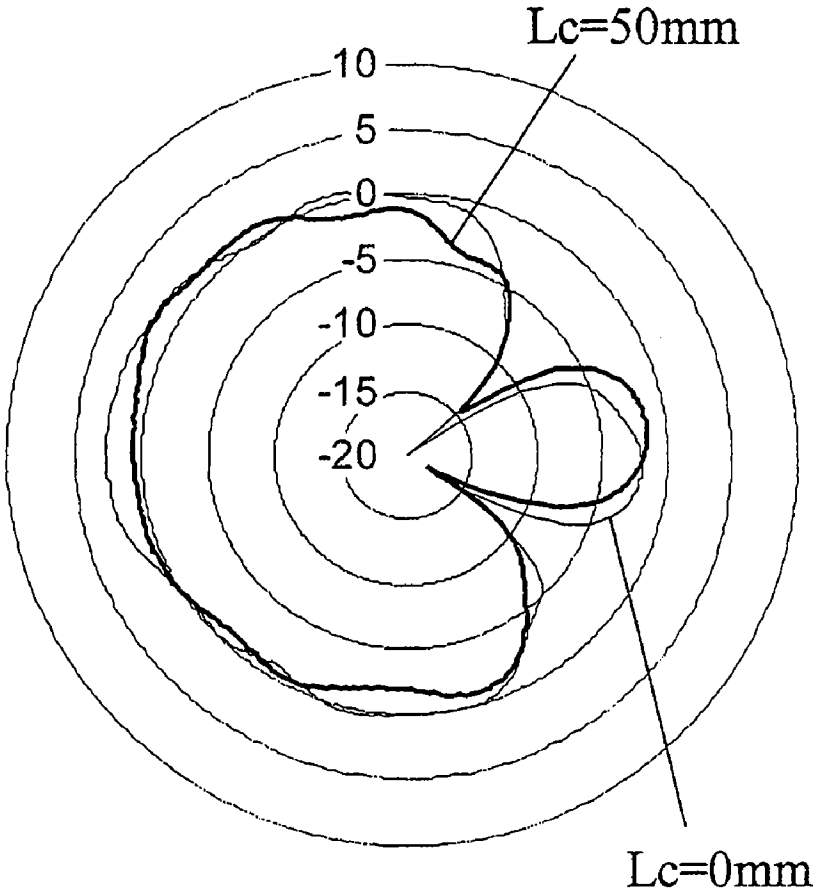
FIGS. 21A and 21B are radiation characteristics diagrams of Example 2 at 9 GHz.
Figure 21B:
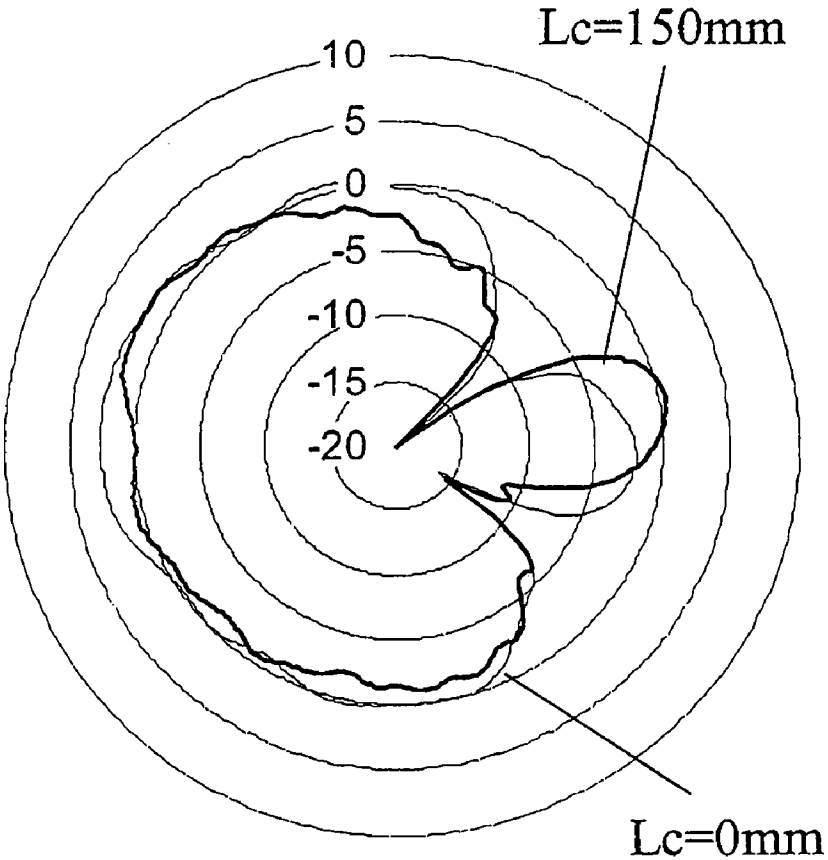
Figure 22A:
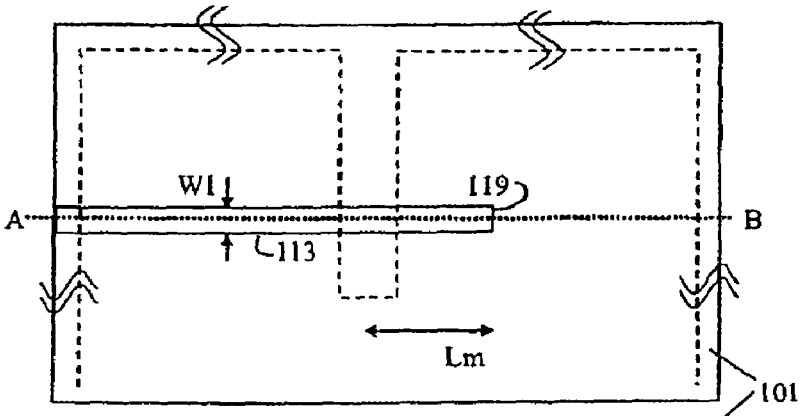
FIG.22A PRIOR ART
FIGS. 22A, 22B, and 22C are schematic diagrams of a traditional ¼ effective wavelength slot antenna (Conventional Example 1).
Figure 22B:
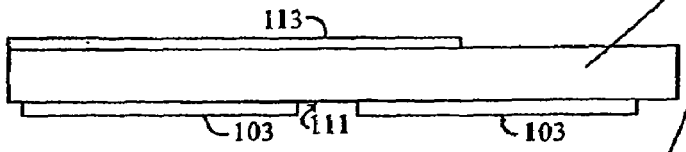
FIG.22B PRIOR ART
Figure 22C:
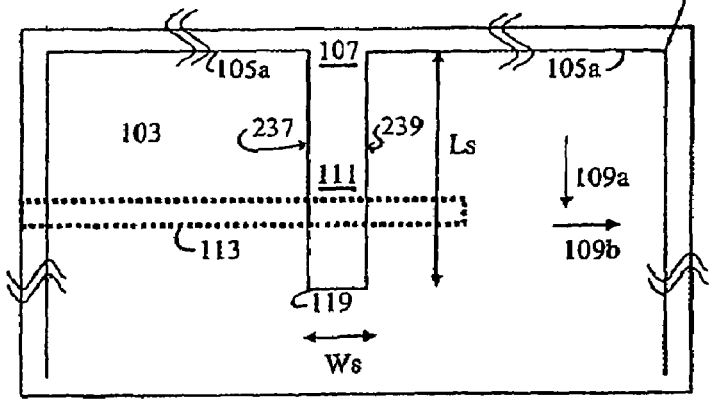
FIG.22C PRIOR ART
Figure 23A:
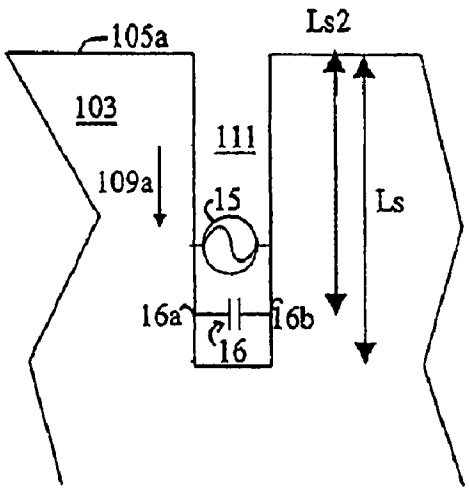
FIG.23A PRIOR ART
FIG. 23A is a schematic structural diagram of a ¼ effective wavelength slot antenna described in Patent Document 1.
Figure 23B:
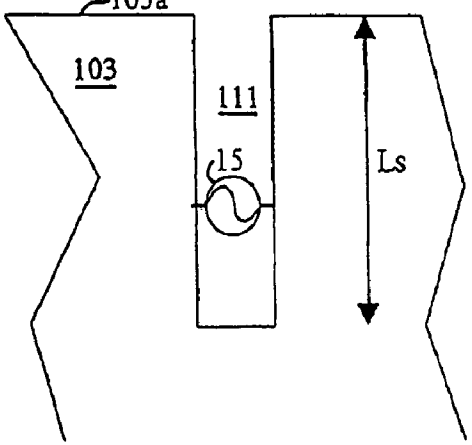
FIG.23B PRIOR ART
FIG. 23B is a schematic structural diagram of the slot antenna when operating in a low-frequency band.
Figure 23C:
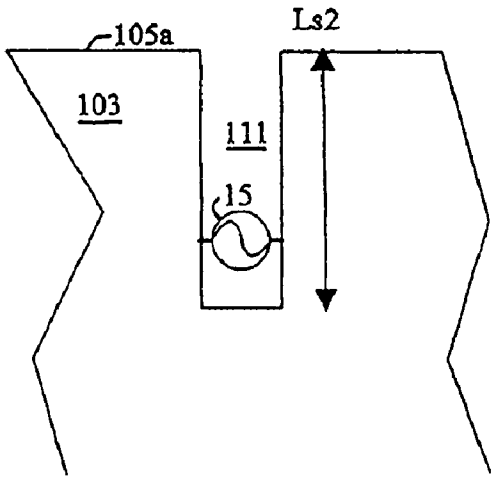
FIG. 23C is a schematic structural diagram of the slot antenna when operating in a high-frequency band.
Figure 24:
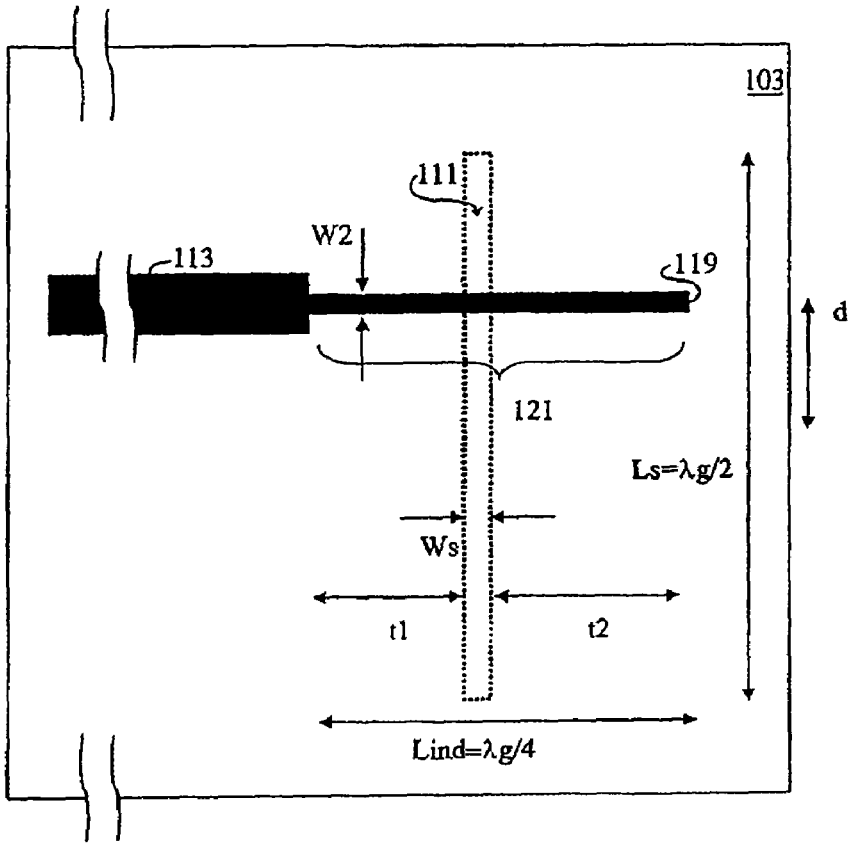
FIG. 24 is an upper schematic see-through view of a slot antenna structure (Conventional Example 3) described in Non-Patent Document 1.
Figure 25:
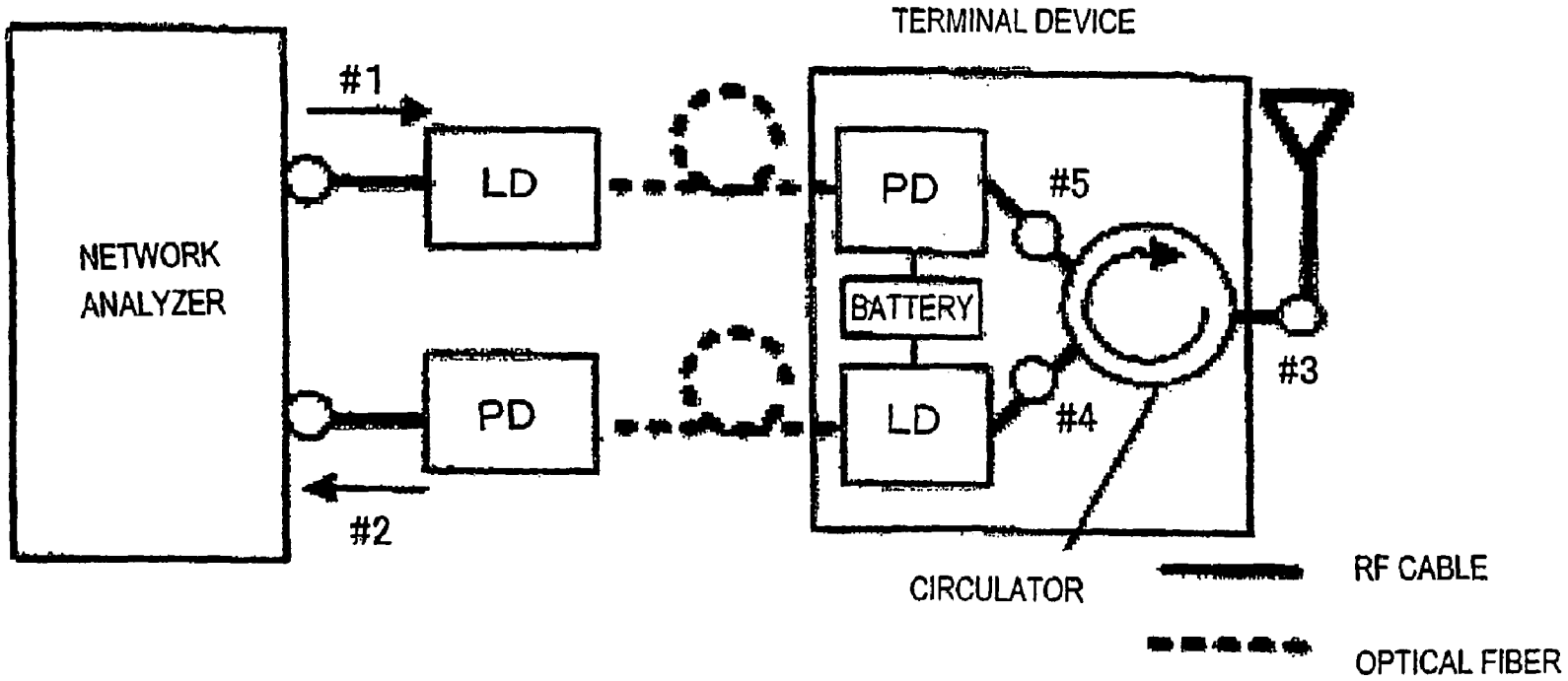
FIG. 25 is a conceptual diagram of a measurement system for a small-sized antenna described in Non-Patent Document 2.

FIGS. 19A and 19B show the radiation characteristics on the YZ plane at 3 GHz in Example 2, in the cases where Lc=50 mm and Lc=150 mm, respectively. Similarly, the radiation characteristics at 6 GHz and 9 GHz are shown in FIGS. 20A and 20B and FIGS. 21A and 21B, respectively. The data shown by a thin line in the figures is the characteristics in the case where Lc=zero, which is presented for comparison. In Example 2, stable radiation characteristics which hardly depended on Lc were realized, whereby attainment of the objective of the present invention was confirmed. Similarly in Example 1, stable radiation characteristics which hardly depended on Lc were obtained. Moreover, in Examples 1 and 2, in the entire operating band, similar effects were obtained with respect to all radiation characteristics, including radiation characteristics on the XZ plane.

Without an increase in circuit footprint and production cost, the matching band can be expanded by a wideband slot antenna according to the present invention. Thus, with a simple construction, it is possible to realize a multi-functional terminal device which would conventionally have required mounting a plurality of antennas. It is also possible to contribute to the realization of a short-range wireless communication system, which exploits a much wider frequency band than conventionally. Moreover, since it is possible to expand the operating band without using chip parts, it is also useful as an antenna which is highly immune to productional variations. Moreover, at frequencies lower than the frequency band of the slot antenna, the slot antenna undergoes the operation of a ground conductor dipole antenna that has the same polarization characteristics as those of the slot antenna, and therefore the antenna can be utilized as a small wideband slot antenna. It can also be used as a small-sized antenna in a system which requires ultrawideband frequency characteristics where digital signals are transmitted or received wirelessly. In either case, when mounted in a terminal device, the present antenna makes it possible to provide characteristics free of instabilities in radiation operation due to being connected to an unbalanced feed circuit which is connected to the antenna.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A wideband slot antenna comprising:

a dielectric substrate having a front face and a rear face;

a ground conductor provided on a rear face of the dielectric substrate, the ground conductor having a finite area;

a slot recessing into the ground conductor, in a depth direction from an open point along an outer edge of the ground conductor, one end of the slot being an open end; and a feed line for feeding a high-frequency signal to the slot, the feed line being formed on the front face of the dielectric substrate and at least partially intersecting the slot, wherein, on the front face of the dielectric substrate, an antenna feed point for connecting an external unbalanced feed circuit to the feed line is provided at a position facing an outer edge of the ground conductor opposite from the open point;

the feed line is bent by at least 90° within a plane of the dielectric substrate so as to reach the antenna feed point;

the slot and the antenna feed point are each disposed at a center of the ground conductor along a width direction which is orthogonal to the depth direction;

in an inductive region spanning a length of a ¼ effective wavelength at a resonant frequency fs of the slot from the open end point, a characteristic impedance of the feed line is prescribed to be higher than 50 Ω;

the feed line and the slot intersect each other at a center of the inductive region;

at a first point near the slot, the feed line branches into a group of branch lines including at least two branch lines, and at least branch line pair in the group of branch lines is connected at a second point near the slot, thus forming at least one loop line in the feed line;

the loop line at least partially intersects a border line between the slot and the ground conductor, and the slot is excited at two or more feed points which are at different distances from the open point along the depth direction;

a maximum value of a loop length of the entire loop line is prescribed to be a length less than 1× effective wavelength at an upper limit frequency of an operating band;

in the group of branch lines, any branch line that does not constitute a part of the loop line but is left open-ended at a leading end has a branch length which is less than ¼ effective wavelength at an upper limit frequency of the operating band; and a distance from the open point to each outer edge at an end of the ground conductor along the width direction is prescribed to a length equal to or less than a ¼ effective wavelength at the frequency fs, and the ground conductor has a lowest-order resonant frequency at a frequency which is lower than fs.

2. The wideband slot antenna of claim 1, wherein the dielectric substrate further has a dielectric layer covering the feed line.

* * * * *

UNITED STATES PATENT AND TRADEMARK OFFICE

CERTIFICATE OF CORRECTION

PATENT NO. : 7,619,578 B2
APPLICATION NO. : 12/176856
DATED : November 17, 2009
INVENTOR(S) : Hiroshi Kanno It is certified that error appears in the above-identified patent and that said Letters Patent is hereby corrected as shown below:

On the title page, in Item "(56) References Cited", under "OTHER PUBLICATIONS", please change "Japanese Office Action, with English translation and certification of English translation, issued in Japanesse Patent Application No. JP 2008-517056, mailed Sep. 9, 2008."

to

--Japanese Office Action, with English translation and certification of English translation, issued in Japanese Patent Application No. JP 2008-517056, mailed Sep. 9, 2008.--

Signed and Sealed this

Fifteenth Day of June, 2010

David J. Kappos

David J. Kappos
*Director of the United States Patent and Trademark Office*